US006088561A

United States Patent [19]

Kawamura et al.

[11] Patent Number: 6,088,561

[45] Date of Patent: Jul. 11, 2000

[54] TONER CARTRIDGE, IMAGE FORMATION APPARATUS COMPRISING TONER CARTRIDGE, AND METHOD OF RECYCLING THE TONER CARTRIDGE

[75] Inventors: Yoshihide Kawamura; Hideo Ichikawa, both of Shizuoka; Shigemi Kanda, Kanagawa, all of Japan

[73] Assignee: Ricoh Company, Ltd., Tokyo, Japan

[21] Appl. No.: 08/955,745

[22] Filed: Oct. 22, 1997

[30] Foreign Application Priority Data

| | | | |
|---|---|---|---|
| Oct. 22, 1996 | [JP] | Japan | 8-279045 |
| Feb. 27, 1997 | [JP] | Japan | 9-043803 |
| Oct. 20, 1997 | [JP] | Japan | 9-286386 |

[51] Int. Cl.[7] ..... G03G 15/08

[52] U.S. Cl. ..... 399/262; 366/312; 399/263; 399/120; 399/106

[58] Field of Search ..... 399/119, 120, 399/106, 254, 255, 256, 262, 263; 220/323, 292; 215/355, 356, 363, 364, 320; 222/DIG. 1; 141/363, 364

[56] References Cited

U.S. PATENT DOCUMENTS

| | | | |
|---|---|---|---|
| 3,853,246 | 12/1974 | Dubois | 222/DIG. 1 |
| 4,813,563 | 3/1989 | Ogden et al. | 215/253 |
| 4,825,244 | 4/1989 | Hediger | 399/255 |
| 4,993,829 | 2/1991 | Naganuma et al. | 399/260 |
| 5,084,734 | 1/1992 | Yoshino et al. | 399/262 |
| 5,293,913 | 3/1994 | Preszler | 141/364 X |
| 5,322,198 | 6/1994 | Ichikawa . | |
| 5,455,662 | 10/1995 | Ichikawa et al. . | |
| 5,489,976 | 2/1996 | Ichikawa . | |
| 5,495,323 | 2/1996 | Meetze, Jr. | 399/120 |
| 5,500,719 | 3/1996 | Ichikawa et al. . | |
| 5,515,143 | 5/1996 | Shiotani | 399/106 |
| 5,526,101 | 6/1996 | Weed | 399/254 |
| 5,548,384 | 8/1996 | Weed | 399/120 |
| 5,555,081 | 9/1996 | Hatta et al. . | |
| 5,564,607 | 10/1996 | Miller et al. | 222/325 |
| 5,627,631 | 5/1997 | Ichikawa et al. . | |
| 5,655,195 | 8/1997 | Ichikawa et al. . | |
| 5,697,038 | 12/1997 | Hatta et al. . | |
| 5,765,079 | 6/1998 | Yoshiki et al. | 399/258 |

*Primary Examiner*—Matthew S. Smith
*Attorney, Agent, or Firm*—Oblon, Spivak, McClelland, Maier & Neustadt, P.C.

[57] ABSTRACT

A toner cartridge includes a container body for holding toner therein, at least one rotatable member including a rotation center shaft, for discharging the toner outside from the container body, disposed in the container body, the container body having an opening at one end thereof in the axial direction of rotation of the rotatable member, and a cap member for opening and closing the opening formed in the container body, which is capable of serving as a bearing member for the rotatable member thereon and is detachable through the opening in the direction of the axis of rotation of the rotatable member. This toner cartridge is available with toner loaded therein, and can be recycled when the toner is used up. A method of recycling this toner cartridge is provided. In addition, an image formation apparatus including this toner cartridge is proposed.

61 Claims, 10 Drawing Sheets

TONER CARTRIDGE, IMAGE FORMATION APPARATUS COMPRISING TONER CARTRIDGE, AND METHOD OF RECYCLING THE TONER CARTRIDGE

BACKGROUND OF THE INVENTION

1. Field of the Invention

The present invention relates to a detachable toner cartridge from which toner is supplied to a development unit in an image formation apparatus, such as copying machines, printers, and facsimile apparatus.

2. Discussion of Background

Image formation apparatus such as copying machines, printers and facsimile apparatus, utilizing electrophotography, are now widely used, in which a latent electrostatic image is formed on a photoconductor and developed with a developer, that is, a so-called toner, to a visible toner image, and the developed toner image is then transferred to a transfer sheet.

In such image formation apparatus utilizing electrophotography, as the toner held in a toner container is consumed, the toner is replenished to the toner container so that the toner is continuously used.

In a toner replenishment method of replenishing the toner to the development unit of the image formation apparatus, which is recently used, a container which holds the toner therein is disposed in the image formation apparatus, and the toner held in the container is loosened and mixed by a rotatable member incorporated in the container, and is then discharged outside from the container through a toner replenishment opening formed in the container. When the toner in the container is used up in the course of repeated image formation in the image formation apparatus, the vacant container is replaced by a new toner replenishment container, with the vacant container being detached from the image formation apparatus, and image formation is resumed. In most cases, the thus detached vacant container is generally scrapped.

However, recently it is desired to recycle the thus detached container without scrapping the same from the viewpoint of the effective use of resources.

In order to recycle the toner replenishment container, it is necessary to remove residual toner deposited on the inner surface of the container or on accessories such as a rotatable member disposed inside the container, or clean the inner surface of the container or accessories such as a rotatable member disposed inside the container. However, it is extremely difficult or impossible to remove the residual toner or clean the container sufficiently for recycling the container due to the structure of the container. For this reason, such toner container has not yet been recycled satisfactorily.

As far as the inventors of the present invention are aware of, it has not been proposed to recycle a toner replenishment container which includes accessories such as the rotatable member.

Japanese Patent Application 4-298774 proposes a method of recycling a toner replenishment container, but the toner replenishment container recycled therein does not include accessories such as the rotatable member.

In the above proposed recycling method, a rotatable member is disposed in a development unit of an image formation apparatus. In a wall of the development unit which is disposed just above the rotatable member, there is formed an opening of the same size as that of the toner replenishment container. The toner replenishment container is of a box type with a double structure comprising an external structure with rigidity made of a resin and an internal container made of paper or a flexible thin plastic material. The internal container is tightly fitted into the external structure, but is separable from the external structure. After toner is placed in the box type toner replenishment container, the upper surface thereof is sealed up. When the replenishment container is used, the seal is removed, and the toner replenishment container is attached to the opening formed in the development unit. After the toner is used up, the internal container is detached from the external structure and burnt up. The external structure is recycled. This proposal, however, is not a complete recycling method, since the internal container is discarded after detached from the external structure, and does not meet the recent social demand.

SUMMARY OF THE INVENTION

It is therefore a first object of the present invention to provide a recyclable toner replenishment container, which allows easy and substantially complete removal of residual toner or smearing deposited within and on a container body thereof and other parts, in particular, from the inner surface of the container body and from the surface of accessories such a rotatable member fixed to the container body.

A second object of the present invention is to provide a recyclable toner replenishment container which is so highly hermetic that toner filling performance, and toner replenishment performance to the development unit of the image formation apparatus are excellent, and such excellent toner filling performance and toner replenishment performance can be maintained after recycled.

A third object of the present invention is to provide a novel toner replenishment container loaded with toner.

A fourth object of the present invention is to provide an image formation apparatus in which a novel toner replenishment container loaded with toner is incorporated.

A fifth object of the present invention is to provide a method of recycling each part of the above toner replenishment container.

The toner replenishment container of the present invention is hereinafter referred to as the toner cartridge.

The above-mentioned first and second objects of the present invention can be achieved by a toner cartridge comprising:

a container body for holding toner therein, at least one rotatable member comprising a rotation center shaft, for discharging the toner outside from the container body, disposed in the container body, the container body having an opening at one end thereof in the axial direction of rotation of the rotatable member, and a cap member for opening and closing the opening formed in the container body, which is capable of serving as a bearing member for the rotatable member thereon and is detachable through the opening in the direction of the axis of rotation of the rotatable member.

In the above toner cartridge, the cap member may comprise a cap portion and a bearing portion which constitute one integral body member, and is referred to as the cap member of type A. In the cap member of type A, the bearing portion is capable of serving as a bearing member for the rotatable member thereon, and has a through hole through which the rotation center shaft passes and is disposed at the opening.

Further, in the above toner cartridge, the opening may have a cylindrical wall which extends from the edge of the opening, and the cap member is attached to the cylindrical wall.

Furthermore, in the above toner cartridge, the cap member comprises a cap portion and a bearing member which are separable, constituting a two-separable member, which is referred to as the cap member of type B, and each of the cap portion and the bearing member has a through hole through which the rotation center shaft passes the cap portion and the bearing member.

Further, the toner cartridge may further comprises a cylindrical wall which is provided so as to encircle the opening, extending around the opening with a space from the edge of the opening, and one of the cap portion or the bearing member is fitted into one of the opening or the cylindrical wall, and the other of the cap portion or the bearing member is fitted into the other of the opening or the cylindrical wall.

Further, in the toner cartridge, the cap member of type A may comprise a fitting portion and a flange portion, and at least one of the cap portion or the bearing member of the cap member of type B may comprise a fitting portion and a flange portion.

Further, in the toner cartridge, the cap portion can be connected to the cylindrical wall through a screw mechanism or a hook mechanism.

Further, in the toner cartridge, at least one of the cap portion or the bearing member can be connected to the opening or the cylindrical wall through a screw mechanism or a hook mechanism.

The hook mechanism may comprise an engagement pawl formed in the cap portion, and an pawl fixing portion may be formed in the cylindrical wall, or a pawl fixing portion may be formed in the cap portion, and an engagement pawl portion may be formed in the cylindrical wall.

The above hook mechanism may comprise an engagement pawl formed in one of the cap portion or the bearing member, and an pawl fixing portion formed in the cylindrical wall, or a pawl fixing portion formed in one of the cap portion or the bearing member, and an engagement pawl portion formed in the cylindrical wall.

In the above toner cartridge, the cap member of type B may constitute a mutually incorporated structure composed of the cap portion and the bearing member.

In the above toner cartridge, it is preferable that the cap portion have a smaller flexibility than the flexibility of the bearing member.

In the above toner cartridge, it is preferable that the length of a portion of the through hole of the bearing member which is in contact with the rotation center shaft be longer than the length of a portion of the through hole of the cap portion which is in contact with the rotation center shaft.

The toner cartridge may further comprise a sealing member having a through hole, which is disposed at the inner side of the cap member in close contact therewith, inside the container body, with the rotation center shaft passing through the through hole of the sealing member.

The toner cartridge may further comprise a sealing member having a through hole, which is disposed at the inner side of the inner most member of the bearing member or the cap portion in close contact therewith, inside the container body, with the rotation center shaft passing through the through hole of the sealing member.

The toner cartridge may further comprise a sealing member having a through hole, which is disposed between the bearing member and the cap portion in close contact with both of the bearing member and the cap portion, with the rotation center shaft passing through the through hole of the sealing member.

The toner cartridge may further comprise a support member for supporting the sealing member, with the support member being fixed on the rotation center shaft, substantially at right angles with respect to the axis of the rotation center shaft.

The toner cartridge may further comprise a support member for supporting the inner most member of the bearing member or the cap portion in the inside of the container body, with the support member being fixed on the rotation center shaft, substantially at right angles with respect to the axis of the rotation center shaft, at the inside of the inner most member.

The toner cartridge may further comprise a detachable fixing member for holding the bearing member, with the cap portion, the sealing member and the bearing member being disposed in this order in view of the inner direction of the container body, and the bearing member being held by the fixing member, and the cap portion being disposed at the opening.

In the toner cartridge, the opening and the cap member may be substantially round shaped in view of the axial direction of the rotation center shaft and coaxially disposed on the axis of the rotation center shaft.

In the toner cartridge, the opening, the cap member, and the cylindrical wall may also be substantially round shaped in view of the axial direction of the rotation center shaft and may be coaxially disposed on the axis of the rotation center shaft.

In the toner cartridge, the opening, the cap portion, and the bearing member may also be substantially round shaped in view of the axial direction of the rotation center shaft and may be coaxially disposed on the axis of the rotation center shaft.

In the toner cartridge, the opening, the cap portion, the bearing member and the cylindrical wall may be substantially round shaped in view of the axial direction of the rotation center shaft and may be coaxially disposed on the axis of the rotation center shaft.

In the toner cartridge, the opening, the cap portion, the bearing member and the sealing member may be substantially round shaped in view of the axial direction of the rotation center shaft and may be coaxially disposed on the axis of the rotation center shaft.

In the toner cartridge, the opening, the cap portion, the bearing member, the cylindrical wall, the sealing member, and the support member may be substantially round shaped in the axial direction of the axis of the rotation center shaft and may be coaxially disposed on the axis of the rotation center shaft.

In the toner cartridge, the cap portion and/or the bearing member may comprise a fitting portion formed by the cylindrical wall provided at an outer peripheral edge portion thereof, and a flange portion formed along a peripheral portion of the cylindrical wall, and the inner diameter of the cylindrical wall may be larger than the diameter of the sealing member, and the cylindrical inner wall may have a concave portion at the inside thereof, in which at least part of the sealing member is incorporated.

In the toner cartridge, the bearing member may be substantially round shaped in view of the axis of the rotation center shaft, and may have a through hole, and a cylindrical wall may be provided between the outer peripheral edge of the bearing member and the through hole of the bearing member, and the inner diameter of the cylindrical wall may be larger than the diameter of the sealing member, and the cylindrical wall may have a concave portion at the inside thereof, in which at least part of the sealing member is incorporated.

In the toner cartridge, the bearing member may be substantially round shaped in view of the axis of the rotation center shaft, and may have a through hole, and the cylindrical wall may be provided between the outer peripheral edge of the bearing member and the through hole of the bearing member, and the inner diameter of the cylindrical wall may be larger than the diameter of the sealing member.

In the toner cartridge, the cap portion may have a flange portion and a cylindrical wall which extends from along the edge of the cap portion, the bearing member may have a through hole, a cylindrical wall may be provided between an outer peripheral edge of the bearing member and the through hole of the bearing member, the bearing member may be a diameter which is larger than the diameter of the flange portion of the cap portion, and the inner diameter of the cylindrical wall provided along the edge of the cap portion may be larger than the outer diameter of the cylindrical wall provided between the outer peripheral edge of the bearing member and the through hole of the bearing member, and the cylindrical wall provided between the outer peripheral edge of the bearing member and the through hole of the bearing member, and the sealing member may be incorporated in the cylindrical wall which extends from along the edge of the cap portion.

In the toner cartridge, the sealing member may be made of felt.

The toner cartridge may further comprises an additional cylindrical wall which is provided along the outer peripheral edge of the bearing member, on the back side of the bearing member with respect to the side thereof on which the cylindrical wall is provided between the outer peripheral edge of the bearing member and the through hole of the bearing member, a notch cut on part of the additional cylindrical wall, a projection provided on the cylindrical wall provided at the opening, the notch and the projection constituting a fixing hook structure.

In the toner cartridge, the rotation center shaft may comprise an engagement separation mechanism by which a central portion of the rotatable member can be separated from the rotation center shaft.

The toner cartridge may further comprise a drive transmission member for driving the rotatable member in rotation, which is disposed at a top end portion of the rotation center shaft on the side of the opening formed in the container body.

The toner cartridge may further comprises a fixing member for fixing the drive transmission member with tight sealing on the outside of the drive transmission member in view of the container body.

In the toner cartridge, the rotatable member is of an agitator type or of a replenishment roller type.

The rotatable member may be a blanked out ladder-shaped agitator provided with a flexible sheet-shaped member extending from the outer peripheral portion of the blanked out ladder-shaped agitator, and the outer peripheral diameter of the flexible sheet-shaped member can be made smaller than the diameter of the opening by pulling out the rotatable member in the axial direction thereof as the rotatable member is rotated.

The rotatable member may also be a blanked out ladder-shaped agitator provided with a flexible sheet-shaped member extending from the outer peripheral portion of the blanked out ladder-shaped agitator, and the outer peripheral diameter of the flexible sheet-shaped member can be made larger than the diameter of the opening after the flexible sheet-shaped member is inserted into the container body.

The rotatable member may also be a blanked out ladder-shaped agitator provided with a flexible sheet-shaped member extending from the outer peripheral portion of the blanked out ladder-shaped agitator, and the outer peripheral diameter of the flexible sheet-shaped member can be made smaller than the diameter of the opening by pulling out the rotatable member in the axial direction thereof as the rotatable member is rotated, and the outer peripheral diameter of the flexible sheet-shaped member can be made larger than the diameter of the opening after the flexible sheet-shaped member is inserted into the container body.

The flexible sheet-shaped member may be made of a polyester film.

The rotatable member may be a replenishment roller.

The toner cartridge may further comprises a sealing member which is disposed between an end surface of the replenishment roller and the cap member in close contact therewith.

The replenishment roller may be a magnetic roller.

The toner cartridge may further comprises a guide member for guiding an end portion of the rotatable member from the opening of the container body to a predetermined attachment position therefor on the opposite side of the opening in the container body when incorporating the rotatable member into the container body, the guide member being fixed near an end portion of the rotation center shaft opposite to the end portion thereof located at the opening, substantially at right angles to the axial direction of the rotation center shaft.

The guide member may be rotatably supported on the rotatable center shaft, with an external peripheral portion of the guide member being in sliding contact with at least part of an inner peripheral surface of the container body.

In the toner cartridge, a plurality of the rotatable members may be disposed in the container body, at least one of which is detachable by pulling from the container body.

The third object of the present invention is achieved by the toner cartridge with toner being loaded in the container body thereof.

The fourth object of the present invention can be achieved by an image formation apparatus comprising a development unit and a toner cartridge which holds toner, wherein the toner cartridge is disposed above the development unit and comprises:

a container body for holding toner therein, at least one rotatable member comprising a rotation center shaft, for discharging the toner outside from the container body, disposed in the container body, the container body having an opening at one end thereof in the axial direction of rotation of the rotatable member, and a cap member for opening and closing the opening formed in the container body, which is capable of serving as a bearing member for the rotatable member thereon and is detachable through the opening in the direction of the axis of rotation of the rotatable member.

The fifth object of the present invention can be achieved by a method of recycling parts which constitute a toner cartridge comprising the steps of:

detaching a cap member having a bearing portion from a container body, which cap member is fitted into an opening formed in the container body and disposed tightly sealed, in such a state that a rotation center shaft which constitutes a rotatable member passes through a through hole formed in the cap member, pulling out the rotatable member disposed in the container body from the opening, and separating the rotation center shaft and the cap member.

In the above method, a deposited material can be removed from at least one of the container body, the rotatable member or the cap member, each of which is separated.

Further, the above method may further comprises the steps of, using the container body, the rotatable member and the cap member, from at least one of which the deposited material is removed, disposing the cap member tightly sealed on a support which is fixed on the rotation center shaft which constitutes the ratable member, with the rotation center shaft passing through the through hole formed in the cap member, inserting a top end of another rotation center shaft which constitutes the ratable member from the opening formed in the container body into the container body, thereby setting the top end portion of the rotation center shaft at a predetermined position, and fixedly fitting the cap member into the opening, thereby constructing the toner cartridge.

The above method may further comprise the step of loading the constructed toner cartridge with toner.

The above method may further comprise the step of incorporating the toner cartridge which is loaded with toner into a predetermined place in an image formation apparatus for image formation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 12-1 is a schematic cross-sectional front view of a sixth embodiment of the toner cartridge of the present invention, in particular, showing the fitting of a cap member comprising a cap portion and a bearing member of type B into an opening formed in the toner container.

FIG. 12-2 is a schematic perspective view of a cap member and other parts to be successively attached to a rotation center shaft in the sixth embodiment of the toner cartridge of the present invention.

FIG. 12-3 is a schematic top view of a bearing member fixed to a fixing member in the sixth embodiment of the toner cartridge of the present invention.

FIG. 13-1 is a schematic perspective view of an upper lid A and a toner holding portion B of a container body, which are separated, in a seventh embodiment of the toner cartridge of the present invention, with a magnetic roller being incorporated in addition to the ladder-shaped agitator type rotatable member provided with a sheet-shaped member made of a polyester film in the container body.

FIG. 13-2 is a schematic partial enlarged perspective view of two openings formed in a toner containing portion B in the seventh embodiment of the toner cartridge of the present invention.

DESCRIPTION OF THE PREFERRED EMBODIMENTS

Figure 1:
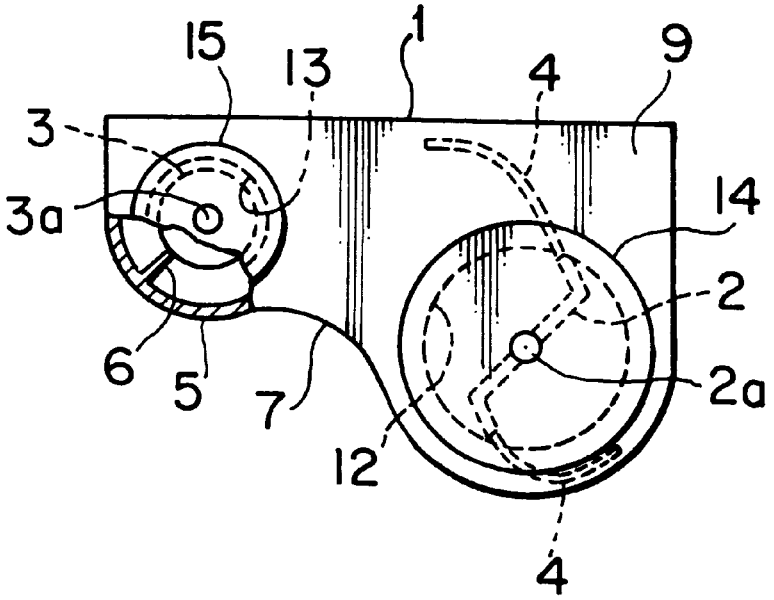
FIG. 1 is a schematic cross-sectional side view of a first embodiment of a toner cartridge of the present invention, in which a drive transmission gear is detached.

The toner cartridge of the present invention has such a mechanical structure that the container body can be separated from other parts of the toner cartridge, and the toner cartridge can be reassembled by fitting the parts together again.

Because of this mechanical structure, first of all, the parts such as the rotatable member are attached to the container body, and the toner cartridge is reassembled. The thus reassembled toner cartridge is loaded with toner by a conventional method and then incorporated into the image formation apparatus. Even when the toner in the toner cartridge is used up in the course of repeated image formation, and the toner cartridge becomes vacant, the vacant toner cartridge is not scrapped. The container body is separated from other parts, and residual toner powder and smearing materials deposited within the container body and on the other parts are removed therefrom, and the toner cartridge can be reassembled by fitting the cleaned container body and parts together again. The thus reassembled toner cartridge can be used again.

In the toner cartridge of the present invention, the container body is separable from other parts, and even when the toner cartridge is recycled by reassembling the toner cartridge, the toner cartridge is so hermetic that no toner leaks and the excellent toner replenishment performance can be maintained.

The shape and size of the container body for the toner cartridge of the present invention may be different depending upon the kind of image formation apparatus in which the toner cartridge is to be incorporated. An example of the container body may be about 15 to 30 cm long, with a side plate with a size of 25 to 75 $cm^2$ fixed to the opposite ends thereof.

The container body may be composed of a toner holding portion and a cap portion, which may be either separable or inseparable. Some container body is made of a metal, but most of such container bodies are made of a resin formed by injection molding.

The container body includes two supporting portions with which two opposite end portions of a rotation center shaft rotatably engage. At least one of the two supporting portions has a through hole. The end portion of the rotation center shaft which is rotatably supported by the through hole is generally connected to a drive source of the main body of the image formation apparatus.

The rotatable member mostly has the rotation center shaft at least on the opposite ends thereof, and also has a mechanism for loosening and mixing the toner placed in the container body, and discharging the toner to the outside, in a central portion thereof. The end portion of one of the rotation center shafts is connected to the drive source of the main body of the image formation apparatus via a drive transmission member such as a gear which is fixed at the end portion of the rotation center shaft, whereby the rotatable member can be driven in rotation.

With respect to the specific shape of the above-mentioned mechanism for loosening and mixing the toner and discharging the toner to the outside, which is included in a central portion of the rotatable member, there are varieties of shapes. Here the rotatable members are roughly classified into two types, depending upon the type of the above-mentioned mechanism disposed in the central portion thereof, an agitator type and a replenishment roller type.

Figure 2:
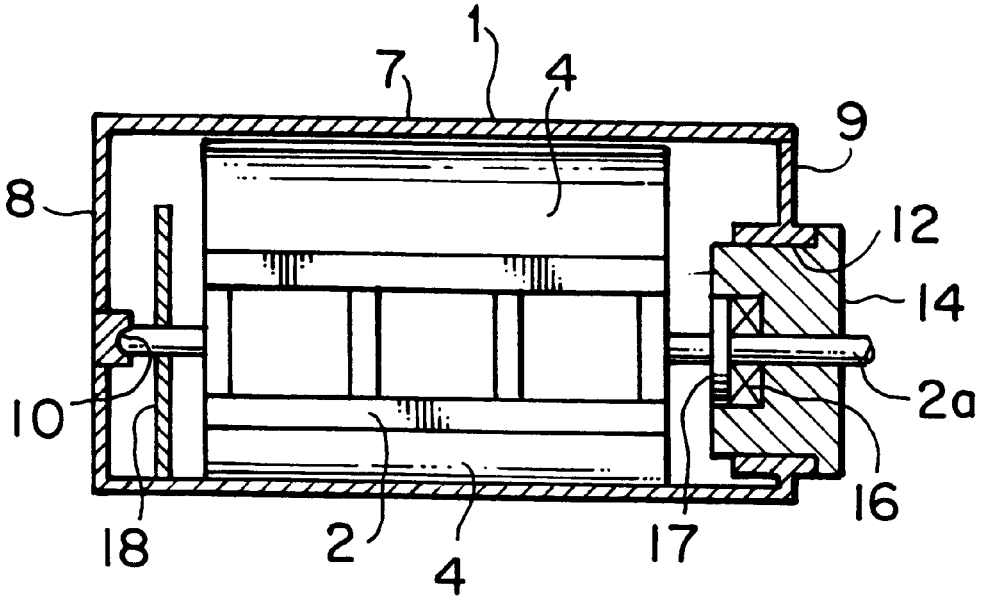
FIG. 2 is a schematic cross-sectional front view of the first embodiment of the toner cartridge of the present invention, in particular, showing the attachment of a ladder-shaped agitator type rotatable member.

Examples of the agitator type rotatable member include a ladder-shaped agitator type rotatable member 2 shown in FIG. 2, a screw type provided with a spiral blade, which may be referred to as auger, a coil type, and a wire type. In short, it is required that the agitator type rotatable member be capable of appropriately loosen the filled toner by the rotation of the rotatable member, transporting the loosened toner to a toner replenishment opening formed in the container body, and appropriately replenishing the toner to the development unit of the image formation apparatus. The mechanism in the central portion of the rotatable member is particularly designed so as to meet the above requirement with respect to the shape and physical strength, using a particular material.

Examples of the replenishment roller type rotatable member include a so-called magnetic roller which is capable of holding magnetic toner on surface thereof with magnetic attraction thereof, and a non-magnetic roller provided with a concave notch portion on the surface thereof, in which non-magnetic toner is held. The replenishment roller type rotatable member is usually disposed near a slit-shaped toner replenishment outlet formed in the container body. Toner is dropped from the replenishment roller type rotatable member which holds toner as the rotatable member is rotated, and the dropped toner is then supplied to the development unit through the slit-shaped toner replenishment outlet.

When the magnetic roller is employed, the toner attracted to and held on the surface of the magnetic roller is scraped off by a toner scraper whose tip end comes into contact with the surface of the magnetic roller.

There is no particular limitation to the kind of rotatable member incorporated in the container body and the number thereof. Usually only one agitator type rotatable member is used or one agitator type rotatable member and one replenishment roller type rotatable member are used in combination.

Toner is loaded into the container body by various methods by modifying the shape of the container body or using a particular device. For example, when toner is loaded into the container body by an air suction method, a toner loading hole and an air suction hole are formed in the container body, so that toner is loaded into the container body as air is sucked from the air suction hole and the toner is loaded through the toner loading hole, and after the loading of the toner is finished, these two holes are plugged up.

Key features of the toner cartridge of the present invention will now be explained.

In the toner cartridge of the present invention, the rotation center shaft for the rotatable member passes through the through hole formed in the cap member, and the cap member is detachably fitted into the opening formed in the container body. In the present invention, the term "a cap member for opening and closing the opening formed in the container body" means a cap member which is capable of plugging and unplugging the opening.

The cap member for use in the toner cartridge of the present invention, which also may serve as a bearing member for the rotatable member, is easy to use to open and close the opening. Once the opening is closed by the cap member or plugged with the cap member, toner does not leak therefrom when the toner is held in the container body and when the toner is being supplied therefrom to the development unit. This close sealing function of the cap member is maintained when the toner cartridge is recycled.

If the toner leaks from the opening, the toner not only cannot be loaded with high packing density into the container body, but also the leaked toner smears the inside of the image formation apparatus and has serious adverse effects on the image formation. If the toner leaks from the gap between the through hole formed in the cap member and the rotation center shaft, the leaked toner is transported onto the bearing portion of the rotation center shaft and into other parts, so that the desired rotation accuracy of the rotation center shaft cannot be maintained, and therefore accurate toner replenishment becomes difficult.

As mentioned above, the cap member for use in the toner cartridge of the present invention may also have a function as a bearing member for the rotation center shaft for the rotatable member. In order to secure the positional accuracy of the cap member which also serves as the bearing member, it is preferable that at least the portion serving as the bearing member in the cap member be composed of a material having high physical strength and minimum distortion.

In the present invention, the cap member may be made so as to include the above-mentioned bearing portion. Alternatively, a separate bearing member may be attached to the cap member. The former is referred to as the cap member of type A, and the latter is referred to as the cap member of type B. The cap member of type B is better than the cap member of type A for use in the present invention, since the material, size, shape and other factors can be determined more freely when making the cap member of type B and the bearing member than when making the cap member of type A.

In the bearing member, a through hole is formed, through which the rotation center shaft passes when used. It is desirable that the through hole formed in the bearing member and the rotation center shaft be coaxially positioned.

It is desirable that the bearing member be made of a material having the same high physical strength and minimum distortion as in the above-mentioned portion serving as the bearing member in the cap member.

In order to have the bearing member exhibit the bearing function sufficiently, it is preferable that the bearing member be made of a material having relatively small flexibility and high abrasive resistance. On the other hand, in order to make easy the opening of the cap member and to prevent the leakage of toner from the cap member, it is preferable that the cap member be made of a material having relatively large flexibility and high elasticity. The two members can be made of, for example, polyethylene or polyacetal with the respective physical strengths being appropriately adjusted.

In order to prevent the rotation center shaft from vibrating or deviating from the rotation center thereof, it is preferable that the length of a portion of the through hole formed in the bearing member which is in contact with the rotation center shaft be longer than the length of a portion of the through hole formed in the cap member which is in contact with the rotation center shaft. It is preferable that the length of a portion of the through hole formed in the bearing member which is in contact with the rotation center shaft be in a range of about 1 to 6 mm, although there is no particular limitation to the length.

In order to prevent the leakage of toner and to secure the tightness between the cap member and the rotation center shaft, it is preferable that a sealing member be employed. It is effective to use the sealing member in close contact at least with the cap member. Furthermore, in order to have the sealing member exhibit the sealing effect thereof sufficiently, it is also effective to provide a cylindrical wall at the cap member in order to incorporate the sealing member in a concave portion of the cylindrical wall and use the sealing member in a depressed state. The use of such a sealing member is effective regardless of the use of the bearing member. When toner is loaded into the container body by the air suction method, it is extremely important to increase the air tightness of the container body.

The sealing member is used with the formation of a through hole therein through which the rotation center shaft passes. It is preferable that the sealing member be made of a material capable of attaining the air tightness and having high elasticity, such as felt, rubber or resin. When necessary, two or more sealing members can be employed.

There is no particular restriction to the positional relationship among the cap member, the bearing member and the sealing material. However, in order to prevent the leakage of toner effectively and to have the bearing member exhibit its bearing function sufficiently, it is preferable that the sealing member be incorporated in the concave portion of the cap member. It is also particularly preferable that the cap member, the sealing member and the bearing member be positioned in this order in view of the outside of the container body.

The sealing member can also be used for the above-mentioned cap member of type A which includes the bearing portion.

It is necessary that the cap member, the bearing member and the sealing member be individually in close contact with each other on the rotation center shaft without deviation in the axial direction thereof. In order to achieve this, it is preferable that at least one of the cap member or the bearing member be provided with a cylindrical wall to form a concave portion, through which the cap member and the bearing member constitute a mutually incorporated structure.

In order to prevent the cap member, the bearing member and the sealing member from deviating from the respective positions thereof on the rotation center shaft in the axial direction thereof, it is effective to hold these members between a support member which is fixedly provided on the rotation center shaft substantially at right angles to the axial direction thereof and a fixing member which is detachably provided on the rotation center shaft.

A drive transmission member, such a gear, which is connected to a drive source and fixed to the rotation center shaft, may also serve as such a fixing member.

The support member and the fixing member can also be used in the same manner as mentioned above for the above-mentioned cap member of type A including the bearing portion.

It is preferable that the support member provided on the rotation center shaft be made integrally with the rotation center shaft, using a resin. It is preferable that the support member be larger in size than the members to be supported by the support member.

In order to secure the rotation of the rotatable member with the cap member of type A or the cap member of type B being firmly fixed to the container body, there may be provided a cylindrical wall which extends from the edge of the opening formed in the container body, or a cylindrical wall which encircles the opening, extending from a predetermined space from the edge of the opening. In the case of the cap member of type A, the cap member is attached to the cylindrical wall, while in the case of the cap member of type B which includes the bearing member, the cap portion is attached to the opening and the bearing member is attached to the cylindrical wall. There is no particular limitation to the length of the cylindrical wall, but it is preferable that the cylindrical wall which extends from the edge of the opening have a length of ½ the diameter of the opening at longest, and the cylindrical wall provided at the cap member or at the bearing have a length of ⅓ the diameter of the opening at longest.

In both the above-mentioned type A and type B, a screw mechanism or a hook mechanism may be provided between the cap member or the bearing member and the cylindrical wall for secure fixing thereof. For example, a hook mechanism can be constructed by forming an engagement pawl in at least one of the cap member or the bearing member, and a pawl fixing portion in the cylindrical wall formed at the opening, alternatively by forming a pawl fixing portion in at least one of the cap member or the bearing member, and an engagement pawl in the cylindrical wall formed at the opening. The pawl fixing portion means a structure such as a projection, a concave portion or a hole. A notch formed in part of the cylindrical wall formed at the cap member or the bearing member, or a notch formed in part of a flange formed at the cylindrical wall may be used as the above-mentioned pawl.

There is no particular restriction to the shape of the opening, the cap member, the bearing member, each cylindrical wall attached thereto, and the support member, but it is preferable that these members be substantially round shaped and also be coaxially disposed in view of the convenience of the attachment of the rotatable member and the recycling operation.

There is no particular restriction to the size of the opening, the cap member, the bearing member, each cylindrical wall attached thereto, and the support member. However, it is preferable that the opening have a diameter of about 5 cm at largest. It is preferable that the cap member be made of an elastic material and slightly larger than the opening in order to have the cap member securely and tightly fit into the opening.

It is also preferable that the through hole formed in each of the cap member, the bearing member and the sealing member have such a diameter that allows the rotation center shaft to rotate smoothly in contact with the inner wall of the through hole.

The cap member and the bearing member may be in the shape of a substantially round plate. Alternatively, the cap member and the bearing may be composed of a fitting portion and a flange portion.

There is no particular restriction to the material for the cap member and the bearing member, but it is preferable that the material therefor be a resin as long as the resin meets the physical strength required for each of the cap member and the bearing member.

Of the two rotation center shafts which constitute the rotatable member, as at least the rotation center shaft which is connected to the drive source, there can be employed a shaft which is integrally connected to the central portion of the rotatable member provided in a conventional container body. However, it is preferable to employ a novel rotation center shaft for use in the present invention, which comprises such a mechanism that makes the rotation center shaft detachable from the central portion. There is no restriction to the length of the detachable rotation center shaft, but it is preferable that the length be about 3 cm at longest.

As the rotatable member, the above-mentioned conventional agitator type rotatable member and replenishment roller type rotatable member can be employed.

In addition, the following novel rotatable member can be used in the present invention, which is specifically employed in a first embodiment of the toner cartridge of the present invention. The ladder-shaped agitator type rotatable member comprises a ladder-shaped agitator and a sheet-shaped member which extends from the ladder-shaped agitator. The rotatable member including the sheet-shaped member has a larger diameter than the diameter of the opening, when the sheet-shaped member is extended to its full length. However, since the sheet-shaped member is flexible, the rotatable member can be easily and accurately incorporated into the container body through the opening when the rotatable member is pushed thereinto while rotated.

When this agitator type rotatable member provided with such a sheet-shaped member is rotated within the container body, even the toner located near the inner wall of the container body is loosened by the sheet-shaped member, so that the toner can be efficiently used. As a result, the amount of residual toner in the container body after use is small and therefore the cleaning work for recycling the toner cartridge can be significantly reduced. In view of the fact that the attachment of the agitator type rotatable member is easy, this agitator type rotatable member is much more effective for recycling than an agitator type rotatable member without such a sheet-shaped member.

Furthermore, in the present invention, there can be provided a plate-shaped guide member, near an end portion of the rotation center shaft opposite to the end portion thereof at which the cap member is disposed, substantially at right angles to the axial direction of the rotation center shaft. By use of this guide member, the rotatable member can be incorporated through the opening into the container body and can be easily and accurately set at a predetermined position in the container body. It is preferable that the shape or size of the guide member be such that the guide member is in sliding contact with part of the inner wall of the container body. As long as the guide member is flexible, the shape or size of the guide member may be such that the guide member catches the opening. For example, a round guide member and an arc-shaped guide member can be employed.

The toner cartridge of the present invention can be assembled without using a special procedure. The same is true when the toner cartridge is reassembled using recycled parts.

Using one of the cap member of type A or the cap member of type B which includes the bearing member, one of the two rotation center shafts which constitute the rotatable member is caused to pass through the hole formed in the cap member. The rotatable member is then inserted into the container body through the opening, with the top end of the other rotation center shaft being directed as a leading end for the insertion of the rotatable member, and set at a predetermined position in the container body. The opening is then tightly plugged with the cap member. The above is a basic procedure for assembling or reassembling of the toner cartridge of the present invention.

When the cap member of type B including the bearing member are employed, or the sealing member is employed, it is necessary that these members maintain in close contact with each on the rotation center shaft in the axial direction thereof, with the rotation center shaft passing through the holes formed therein. In particular, when these members constitute a mutually incorporated structure, it is necessary that these members be in a highly close contact state. The same is true when these members are held between the support member fixed on the rotation center shaft and the detachably disposed fixing member.

It is preferable that of the two rotation center shafts which constitute the rotatable member, the rotation center shaft on the side of the cap member have such a structure that the rotation center shaft is separable from the central portion of the rotatable member, and that the assembling be conducted by the steps of disposing the above-mentioned plurality of members on the rotation center shaft in close contact with each other as mentioned above, then connecting the central portion of the rotatable member to the rotation center shaft, and plugging the opening formed in the container body with the cap member.

As mentioned above, when the rotatable member of the agitator type provided with a flexible sheet-shaped member in the central portion thereof is used, it is necessary to insert the rotatable member into the container body from the opening thereof as the rotatable member is rotated, whereby the sheet-shaped member is wound around the central portion of the rotatable member so that the rotatable member can be smoothly inserted into the container body.

Furthermore, as mentioned above, when the rotatable member is inserted into the container body through the opening thereof with the provision of the guide member at the rotatable member, in particular, with the guide member being formed so as to be in sliding contact with the inner surface of the container body, the rotatable member can be accurately set at a predetermined position in the container body. The guide member is particularly effective when used in combination with the agitator type rotatable member provided with the flexible sheet-shaped member in the central portion thereof.

The cap member can be fitted into the opening formed in the container body with the application of pressure thereto. It is preferable that the applied pressure be in the range of about 1 to 10 kg.

The toner cartridge can be disassembled with detachment of the rotatable member from the container body in a procedure which is in reverse order to the above-mentioned assembling procedure.

There is no particular restriction to the method of removing deposited materials from the separated container body and the rotatable member. One method is to clean those members with water and a surfactant. In addition, for example, a method of scattering the deposited materials with compressed air, and a method of vacuuming the deposited materials can be employed.

After the removal of the deposited materials, the cleaned parts are assembled to recycle the toner cartridge. The recyclable number of the toner cartridge of the present invention depends upon the structure, the size, or the materials used for the toner cartridge. According to a test conducted by incorporating the toner cartridge in a commercially available facsimile apparatus (Trademark "RIFAX BL 100" made by Ricoh Company, Ltd.) used as a test machine, it has been confirmed that the toner cartridge of the present invention can be recycled at least 5 to 10 times.

If some parts such as the container body, the rotatable member, the cap member and other parts for the toner cartridge are found no longer usable after the above-mentioned disassembling or cleaning, such parts should be replaced with new ones.

With respect to the kind of toner that can be held in the toner cartridge of the present invention, there is no particular restriction as long as the toner is used for the image formation process utilizing electrophotography. Therefore, conventional one-component toners and two-component toners which may be either magnetic or non-magnetic can be held in the toner cartridge of the present invention.

There is no particular restriction to the method of loading the toner into the toner cartridge of the present invention, and conventional methods can be employed. For high density loading of the toner, however, the above-mentioned air suction method is particularly effective.

The toner loaded toner cartridge of the present invention is mounted at such a posture that a toner replenishment outlet formed in the container body is situated above the development unit of the image formation apparatus, and the drive transmission member fixed to the top end of the rotation center shaft provided in the container body is connected to a rotation drive source provided in the image formation apparatus, so that the rotatable member is driven in rotation when the image formation apparatus is in operation, and the toner is transported to the development unit through the toner replenishment outlet, whereby latent electrostatic images can be developed into visible toner images.

There is no particular restriction to the number of revolution of the rotatable member during the operation of the image formation apparatus. With respect to the agitator type rotatable member, it is preferable that the number of revolution be in the range of 10 to 40 rpm, and the torque therefor be in the range of 0.5 to 3.0 N.m.

With reference to FIGS. 1 to 6, a first embodiment of the toner cartridge of the present invention will now be explained.

Figure 4:
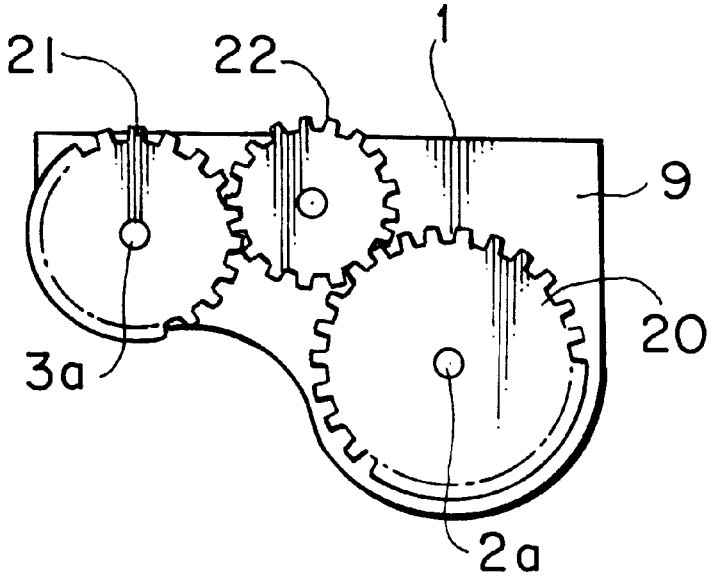
FIG. 4 is a schematic cross-sectional side view of the first embodiment of the toner cartridge of the present invention, in particular, showing the attachment of drive transmission gears.
Figure 5:
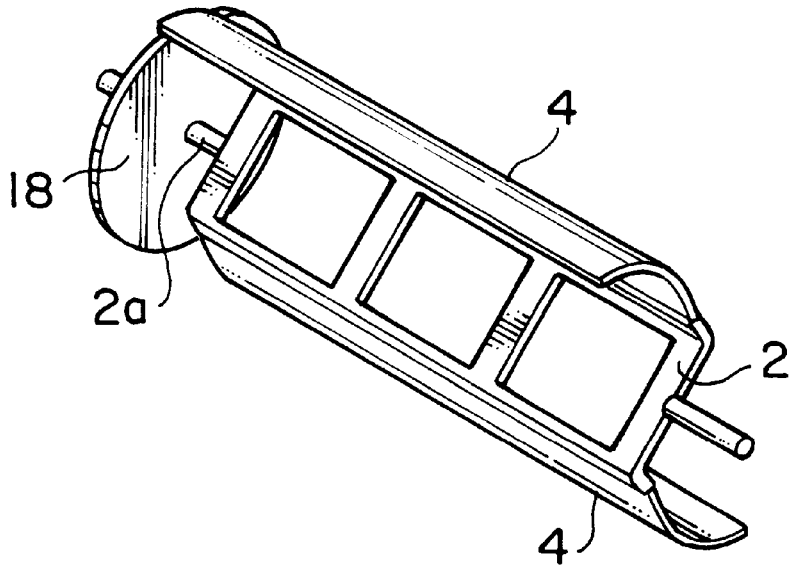
FIG. 5 is a perspective view of the ladder-shaped agitator type rotatable member with the attachment of a guide plate in the first embodiment of the toner cartridge of the present invention.
Figure 6:
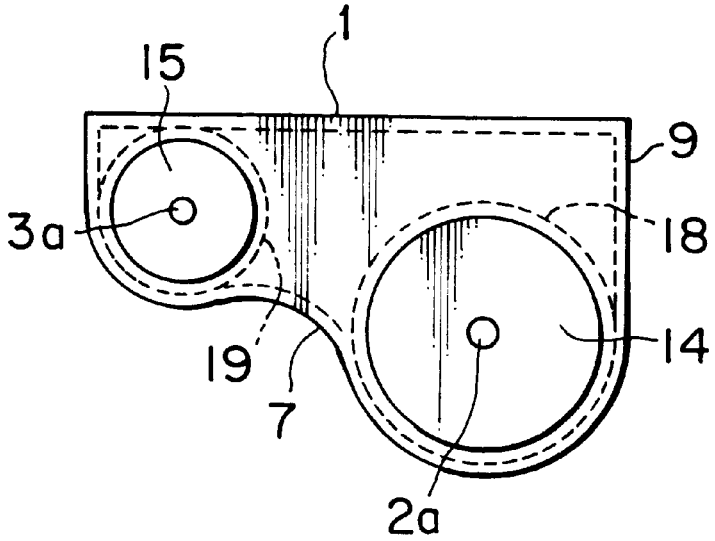
FIG. 6 is a schematic cross-sectional side view of the first embodiment of the toner cartridge of the present invention, in particular, showing the positional relationship between a container body and the guide plate in the first embodiment of the toner cartridge of the present invention.

FIGS. 1 and 4 are schematic cross-sectional side views of the first embodiment of the toner cartridge of the present invention.

Figure 3:
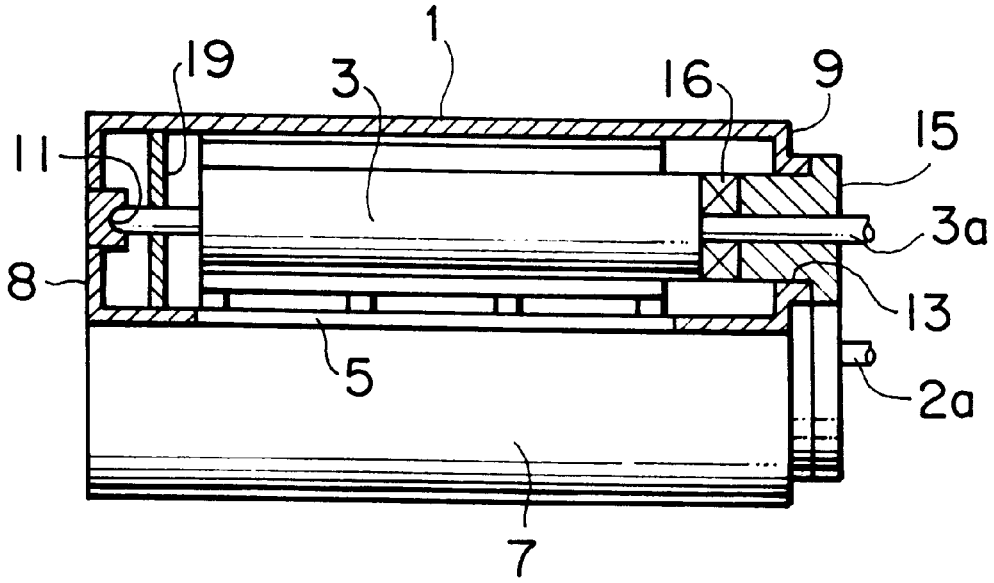
FIG. 3 is a schematic cross-sectional front view of the first embodiment of the toner cartridge of the present invention, in particular, showing the attachment of a magnetic roller.

FIGS. 2 and 3 are schematic partially cutaway front views of the first embodiment of the toner cartridge of the present invention.

This toner cartridge comprises a container body 1 which holds a magnetic toner therein, a ladder-shaped agitator type rotatable member 2, which is rotatably disposed in the container body 1 and has a function of discharging the magnetic toner from the container body 1 to the outside thereof, and a magnetic roller 3. A central portion of the ladder-shaped agitator type rotatable member 2 is hereinafter referred to as the agitator. The ladder-shaped agitator type rotatable member 2 also stirs the magnetic toner in the container body 1 and transports the magnetic toner onto the magnetic roller 3.

The ladder-shaped agitator type rotatable member 2 comprises a conventional agitator and a flexible sheet-shaped member 4 which is provided on the outer peripheral surface of the conventional agitator, whereby the above-mentioned function of the ladder-shaped agitator type rotatable member 2 is improved.

There is no particular restriction to the material for the sheet-shaped member 4 as long as the material has such flexibility that allows the rotatable member 2 to be attached to an opening 12 formed in the container body 1, and to be detached therefrom. In this embodiment, however, a so-called "Mylar", which is a polyester sheet, is employed as the material for the sheet-shaped member 4. As the sheet-shaped member 4, a rectangular sheet with such a width that the sheet comes into contact with the inner surface of the container body 1 when the agitator is rotated, and with almost the same length as that of the agitator of the rotatable member 2 in the axial direction thereof can be employed. This rectangular sheet may have a plurality of notches in the peripheral direction of the rotation thereof. Furthermore, as the sheet-shaped member 4, the above-mentioned rectangular sheet which is divided into a plurality of parts in the axial direction of the rotatable member 2 may also be employed.

The magnetic roller 3 attracts the magnetic toner to the surface thereof by the magnetic attraction thereof and carries the attracted magnetic toner to a toner supply outlet 5. The magnetic toner is then scraped off the surface of the magnetic roller 3 by a scraper rib 6, so that the magnetic toner is discharged from the toner supply outlet 5 outside the container body 1.

The container body 1 comprises a drum portion 7 and a pair of side plates 8 and 9.

The rotatable member 2 and the magnetic roller 3 are disposed in such a manner that the respective rotation center shafts 2*a* and 3*a* are parallel to each other.

In the inside surface of the side plate 8, substantially conically concave holding portions 10 and 11 are formed, with which the top end portions of the above-mentioned rotation center shafts 2*a* and 3*a* rotatably engage.

In the other side plate 9, there are formed the opening 12 having a slightly larger diameter than the rotation diameter of the rotatable member 2, and an opening 13 having a slightly larger diameter than the magnetic roller 3. The opening 12 is, for example, a circular opening with a diameter of about 2.5 cm. At the opening 12, a cylindrical wall with a height of about 5 mm is formed, which extends from the edge of the opening 12.

The rotatable member 2 is so disposed that the rotatable member 2 can be taken out of the container body 1 or inserted back into the container body 1 as desired by pulling out the rotatable member 2 in the axial direction of the rotation center shaft 2*a* from the opening 12 or by pushing the rotatable member 2 in the opposite axial direction of the rotation center shaft 2*a* from the opening 12.

The magnetic roller 3 is also so disposed that the magnetic roller 3 can be taken out of the container body 1 or inserted back into the container body 1 as desired by pulling out the magnetic roller 3 in the axial direction of the rotation center shaft 3*a* from the opening 13 or by pushing the magnetic roller 3 in the opposite axial direction of the rotation center shaft 3*a* from the opening 13.

At the opening 12, there is disposed a round cap member 14 which has a function of rotatably supporting the rotation center shaft 2*a*, comprises a fitting portion and a flange portion, and is made of a resin. At the opening 12, there is also disposed a round sealing member 16 made of felt for preventing the leakage of the toner from the opening 12.

At the opening 13, there is disposed a round cap member 15 which has a function of rotatably supporting the rotation center shaft 3*a*, comprises a fitting portion and a flange portion, and is made of a resin. At the opening 13, there is also disposed a round sealing member 16 made of felt for preventing the leakage of the toner from the opening 13.

In each of the cap members 14 and 15, and the sealing members 16, there is formed a through hole through which the respective rotation center shaft 2*a* or 3*a* passes.

The cap members 14 and 15 can be fitted into the respective openings 12 and 13 with the application of pressure thereto.

The sealing member 16 on the side of the rotatable member 2 is fixedly held between a support member 17 fixed to the rotation center shaft 2*a* and the end surface of the cap member 14.

The sealing member 16 on the side of the magnetic roller 3 is fixedly held between the end surface of the cap member 15 and the side surface of the magnetic roller 3.

The sealing member 16 on the side of the rotatable member 2 may also fixedly held between the end surface of the cap member 14 and the side surface of the rotatable member 2.

At the top end portion of the rotation center shaft 2*a*, a round guide plate 18 made of a film with a predetermined hardness and flexibility is rotatably supported.

The guide plate 18 has a function of leading the top end of the rotation center shaft 2*a* so as to come into the above-mentioned concave holding portion 10 when the rotatable member 2 is inserted together with the guide plate 18 into the container body 1 from the opening 12, with part of the peripheral portion of the guide plate 18 in sliding contact with the inner surface of the drum portion 7 of the container body 1. The diameter of the guide plate 18 is slightly larger than the diameter of the opening 12. However, the guide plate 18 is made of a flexible material, so that the guide plate 18 can be inserted into the container body 1 from the opening 12 by deforming the guide plate 18.

At the top end portion of the rotation center shaft 3*a*, a round guide plate 19 made of a film with a predetermined hardness and flexibility is rotatably supported.

The guide plate 19 has a function of leading the top end of the rotation center shaft 3*a* so as to come into the above-mentioned concave holding portion 11 when the magnetic roller 3 is inserted together with the guide plate 19 into the container body 1 from the opening 13, with part of the peripheral portion of the guide plate 19 in sliding contact with the inner surface of the drum portion 7 of the container body 1. The diameter of the guide plate 19 is slightly larger than the diameter of the opening 13. However, the guide plate 19 is made of a flexible material, so that the guide plate 19 can be inserted into the container body 1 from the opening 13 by deforming the guide plate 19.

A gear 20 and a gear 21 are respectively fixed to the top end portion of the rotation center shaft 2*a* and to the top end portion of the rotation center shaft 3*a*, which protrude from the outside of the side plate 9. A transmission gear 22 engages the gears 20 and 21.

With the toner loaded in the container body 1 of the thus constructed toner cartridge, the toner cartridge is incorporated in a predetermined place of an image formation apparatus such as a copying machine or a printer, and an image formation process is carried out. In accordance with the initiation of the image formation process, drive force is transmitted from a drive section of the image formation apparatus to the gears 20 and 21, so that the rotatable member 2 and the magnetic roller 3 are driven in rotation on the rotation center shaft 2*a* and the rotation center shaft 3*a*, respectively. With the rotation of the rotatable member 2, the toner in the container body 1 is stirred and then transported onto the magnetic roller 3. The magnetic toner attracted to the magnetic roller 3 is then transported up to the toner supply outlet 5. The magnetic toner is then scraped off the surface of the magnetic roller 3 by the scraper rib 6, so that the magnetic toner is discharged from the toner supply outlet 5 into a development unit of the image formation apparatus.

In the course of the repetition of this image formation process, the container body 1 eventually becomes vacant. When the container body 1 becomes vacant, the toner cartridge is removed from the image formation apparatus and a new toner loaded toner cartridge is incorporated therein.

The thus removed toner cartridge is cleaned for recycling the same. When the toner cartridge is cleaned, the cap members 14 and 15 are respectively removed from the openings 12 and 13. The rotatable member 2 is pulled out of the container body 1 in the axial direction of the rotation center shaft 2*a* through the opening 12, and the magnetic roller 3 is also pulled out of the container body 1 in the axial direction of the rotation center shaft 3*a*. When the rotatable member 2 is taken out of the opening 12, the rotatable member 2 is pulled out as the rotatable is being member 2 on the rotation center shaft 2*a*, whereby the outer peripheral diameter of the rotatable member 2 including the sheet-shaped member 4 can be made smaller than the diameter of the opening 12 and can be pulled out smoothly and easily.

After the rotatable member 2 and the magnetic roller 3 are removed from the container body 1, the inside of the container body 1, the rotatable member 2 and the magnetic roller 3 are washed with pure water. The inside of the container body 1 can be cleaned easily and completely since the rotatable member 2 and the magnetic roller 3 are not incorporated within the container body 1. Furthermore, the rotatable member 2 and the magnetic roller 3, which are removed from the container body 1, can also be cleaned easily and completely.

After the inside of the container body 1, the rotatable member 2 and the magnetic roller 3 are cleaned, the rotatable member 2 and the magnetic roller 3 are incorporated back into the container body 1.

When the rotatable member 2 is incorporated into the container body 1, the rotatable member 2, with the guide plate 18 attached to the top end portion of the rotation center shaft 2*a*, is inserted into the container body 1 through the opening 12. At this moment, the rotatable member 2 is inserted as the rotatable member 2 is being rotated on the rotation center shaft 2*a*, whereby the outer peripheral diameter of the rotatable member 2 including the sheet-shaped member 4 can be made smaller than the diameter of the opening 12 and can be inserted into the container body 1 through the opening 12 smoothly and easily. Also the insertion is carried out with at least part of the peripheral edge portion of the guide member 18 being in sliding contact with the inside surface of the drum portion 7 of the container body 1, whereby the leading end portion of the rotation center shaft 2*a* can be precisely led into the concave holding portion 10 and can be securely engaged with the concave holding portion 10. After the rotatable member 2 including the sheet-shaped member 4 has been inserted into the container body 1, the sheet-shaped member 4 is stretched by the elasticity thereof and the diameter of the rotatable member 2 including the sheet-shaped member 4 become greater than the diameter of the opening 12.

The magnetic roller 3 can also be incorporated into the container body 1 in the same manner as in the case of the rotatable member 2. More specifically, the magnetic roller 3, with the guide plate 19 attached to the top end portion of the rotation center shaft 3*a*, is inserted into the container body 1 thorough the opening 13. At this moment, the magnetic roller 3 is inserted into the container body 1 through the opening 13, with at least part of the peripheral edge portion of the guide member 19 being in sliding contact with the inside surface of the drum portion 7 of the container body 1, whereby the leading end portion of the rotation center shaft 3*a* can be precisely led into the concave holding portion 11 and can be securely engaged with the concave holding portion 11. Thus, the rotatable member 2 and the magnetic roller 3 can be disposed at the respective right positions in the container body 1 by use of the guide plates 18 and 19, respectively, so that the attachment precision and the rotation performance of the rotatable member 2 and the magnetic roller 3 in the recycled toner cartridge can be precisely maintained.

After the rotatable member 2 and the magnetic roller 3 are incorporated into the container body 1, the cap members 14 and 15, with the attachment of the sealing member 16 thereto, are respectively fitted with the application of pressure into the openings 12 and 13, whereby the sealing member 16 can be firmly held between the cap member 14 and the support member 17, or between the cap member 15 and the end surface of the magnetic roller 3.

Figure 7:
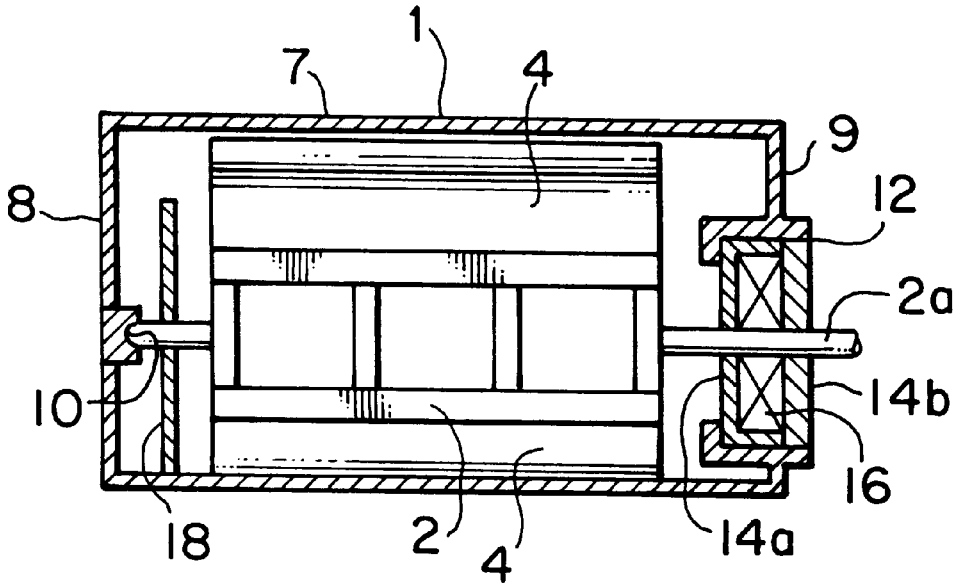
FIG. 7 is a schematic cross-sectional side view of the first embodiment of the toner cartridge of the present invention, in particular, showing the structure of a modified cap member that can be employed in the present invention.

In the above explained first embodiment of the toner cartridge of the present invention, each of the cap members 14 and 15 has the bearing function as well. However, as shown in FIG. 7, the cap member 14 may be composed of a cap portion 14*a* and a bearing member 14*b*, which are separately formed. The cap member 15 can also be constructed in the same fashion, comprising a cap portion and a bearing member, although it is not shown here.

Further, in the above-mentioned first embodiment of the toner cartridge of the present invention, the magnetic toner is employed, so that the magnetic roller 3 is used in addition to the ladder-shaped agitator type rotatable member 2 are used in the container body 1. However, the rotatable member for use in this embodiment is not limited to the above-mentioned rotatable member 2.

Figure 8:
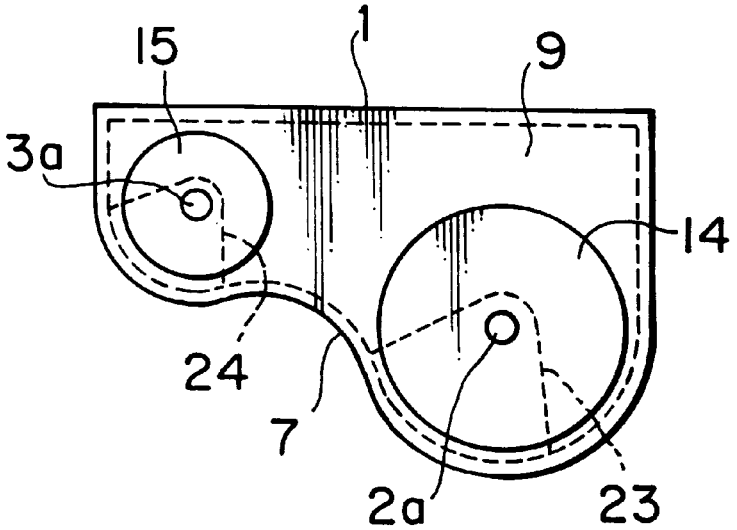
FIG. 8 is a schematic cross-sectional side view of a second embodiment of the toner cartridge of the present invention, in particular, showing the shape of a guide plate, and the positional relationship between the container body and the guide plate.

With reference to FIG. 8, a second embodiment of the toner cartridge of the present invention will now be explained, wherein the same reference numerals as in FIGS. 1 to 7 designate identical or corresponding parts shown in FIGS. 1 to 7.

In the second embodiment, the round guide plates 18 and 19 employed in the first embodiment shown in FIGS. 1 to 7 are respectively replaced by fan-shaped guide plates 23 and 24. The fan-shaped guide plates 23 and 24 are made of the same film material as that for the guide plates 18 and 19 employed in the first embodiment.

In this second embodiment, the guide plate 23 is rotatably supported on the rotation center shaft 2*a* of the rotatable member 2. The guide plate 23 has a function of leading the top end of the rotation center shaft 2*a* so as to come into the above-mentioned concave holding portion 10 when the rotatable member 2 is inserted together with the guide plate 23 into the container body 1 from the opening 12, with an arc-shaped outer peripheral portion of the guide plate 23 in sliding contact with the inner surface of the drum portion 7 of the container-body 1.

The guide plate 24 is rotatably supported on the rotation center shaft 3*a* of the magnetic roller 3. The guide plate 24 has a function of leading the top end of the rotation center shaft 3*a* so as to come into the above-mentioned concave holding portion 11 when the magnetic roller 3 is inserted together with the guide plate 24 into the container body 1 from the opening 13, with an arc-shaped peripheral portion of the guide plate 24 in sliding contact with the inner surface of the drum portion 7 of the container body 1.

Figure 9:
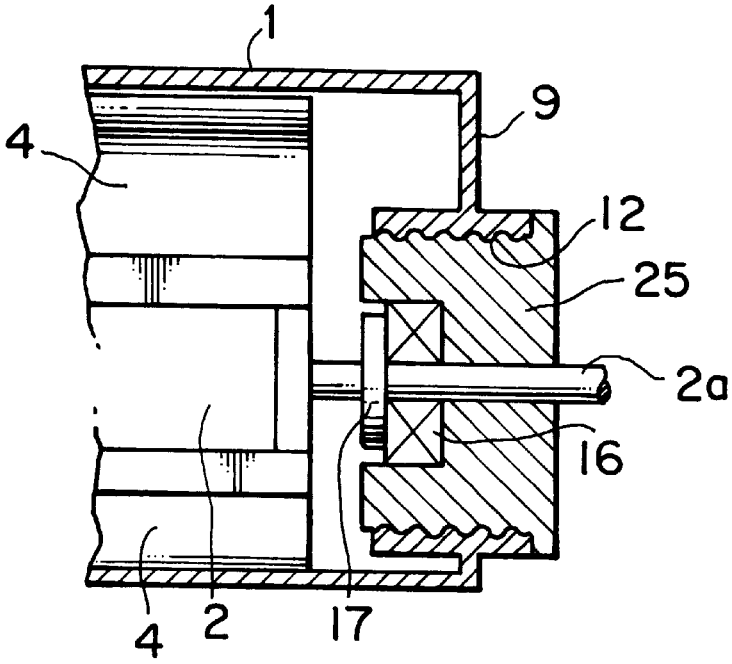
FIG. 9 is a schematic cross-sectional front view of a third embodiment of the toner cartridge of the present invention, in particular, showing the attachment of a cap member.

With reference to FIG. 9, a third embodiment of the toner cartridge of the present invention will now be explained, wherein the same reference numerals as in FIGS. 1 to 7 designate identical or corresponding parts shown in FIGS. 1 to 7.

In the third embodiment, a cap member 25 is screwed into the opening 12. The cap member 25 also has a function of rotatably supporting the rotation center shaft 2*a*, that is, a bearing function, in the same manner as in the above-mentioned cap member 14. A cap member (not shown) attached to the opening 13 from which the magnetic roller 3 can be inserted into the container body 1 or taken out of the container body 1 has the same structure as that of the above-mentioned cap member 25.

In the third embodiment, the screw-on direction, or the fastening direction, of the cap member 25 is made the same as the rotation direction of the rotatable member 2, and the screw-on direction, or the fastening direction, of the cap member for the magnetic roller 3 is made the same as the rotation direction of the magnetic roller 3, whereby the loosening or detachment of the cap member 25 and the cap member for the magnetic roller 3 while in use can be prevented. By screwing the cap member 25, the sealing member 16 can be fixed.

Figure 10:
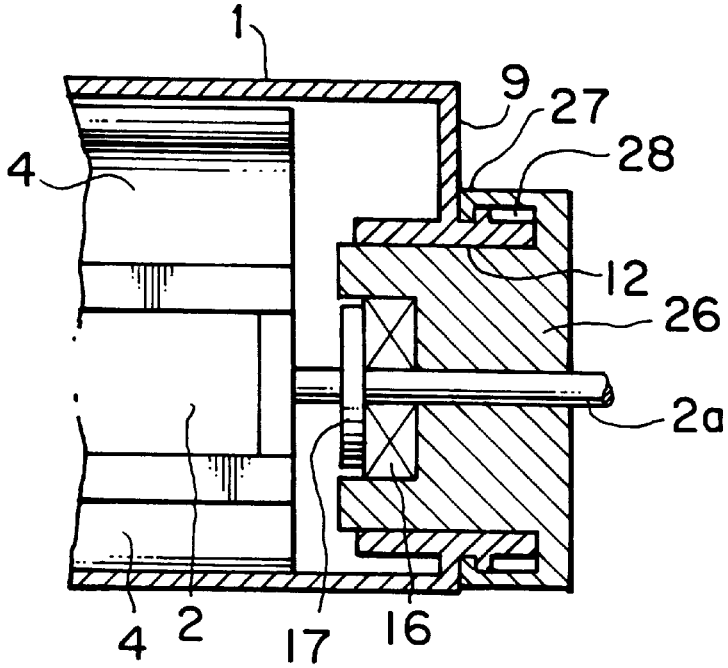
FIG. 10 is a schematic cross-sectional front view of a fourth embodiment of the toner cartridge of the present invention, in particular, showing the attachment of a cap member.

With reference to FIG. 10, a fourth embodiment of the toner cartridge of the present invention will now be explained, wherein the same reference numerals as in FIGS. 1 to 7 designate identical or corresponding parts shown in FIGS. 1 to 7.

In the fourth embodiment, a cap member 26 is attached to the opening 12, using an engagement pawl 27.

As illustrated in FIG. 10, the engagement pawl 27 is formed in the cap member 26. A projection 28 is formed on the outer peripheral portion of the opening 12. The projection 28 engages the engagement pawl 27. The cap member 26 can be detached from the opening 12 by turning the cap member 26 to a position where the engagement pawl 27 is disengaged from the projection 28, and then causing the cap member 26 to slide in the direction away from the opening 12. The cap member 26 also has a function of rotatably supporting the rotation center shaft 2*a*, that is, a bearing function, in the same manner as in the above-mentioned cap member 14 and cap member 25. A cap member (not shown) attached to the opening 13 from which the magnetic roller 3 can be inserted into the container body 1 or taken out of the container body 1 has the same structure as that of the above-mentioned cap member 26.

The thus constructed cap member 26 is easy to attach and detach, and is effective for the improvement of the efficiency of the recycling work. By the attachment of the cap member 26, the sealing member 16 can be fixed.

In each of the above explained embodiments, as the rotatable member, the agitator type rotatable member 2 and the magnetic roller 3 are used. However, when a non-magnetic toner is employed, only the agitator type rotatable member 2 is used. Furthermore, as the rotatable member, an auger can be employed for discharging the toner from the container body 1.

Figure 11:
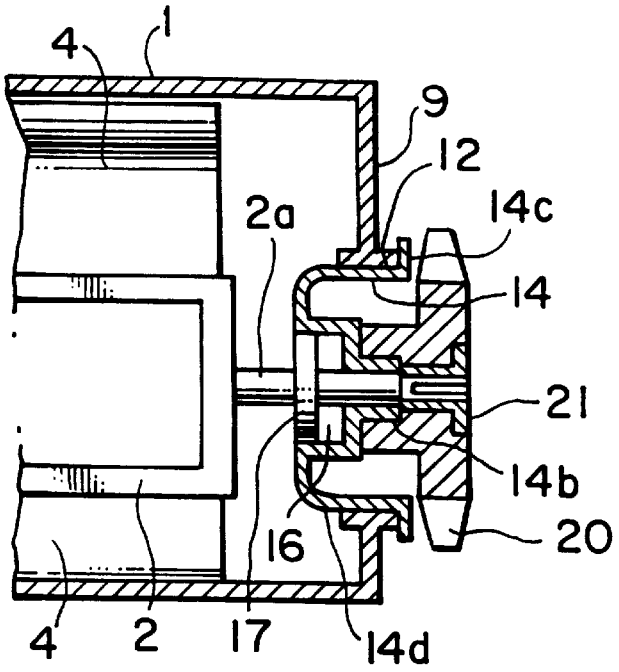
FIG. 11 is a schematic cross-sectional front view of a fifth embodiment of the toner cartridge of the present invention, in particular, showing the fitting of a cap member of type A comprising a cap portion and a bearing portion into an opening formed in the toner container.

With reference to FIG. 11, a fifth embodiment of the toner cartridge of the present invention will now be explained, wherein the same reference numerals as in FIGS. 1 to 7 designate identical or corresponding parts shown in FIGS. 1 to 7.

In the fifth embodiment, as the cap member 14, the cap member comprising a cap portion and a bearing portion 14*b* of type A is employed. The rotation center shaft 2*a* is passed through the through hole formed in the cap member 14. The cap member 14 is held between (a) a support member 17 which is integrally disposed on the rotation center shaft 2*a* and (b) a gear 20 which is fixed to the rotation center shaft 2*a* by a pawl, with the sealing member 16 being interposed as illustrated in FIG. 11. Thus, the cap member 14 is fitted into the opening 12. The cap member 14 comprises a flange portion 14*c* and a fitting portion 14*d*. In order to improve the accuracy of the maintenance of the positional relationship between the bearing portion 14*b* and the rotation center shaft 2*a*, the portion of the bearing portion 14*b* which is in contact with the rotation center shaft 2*a* is made relatively long, and accordingly the fitting portion 14*d* is made relatively thick. At the bottom of the fitting portion 14*d*, there is formed a concave portion into which the sealing member 16 made of felt is fitted, and the sealing member 16 is held between the support member 17 and the bottom of the fitting portion 14*d*.

The rotatable member employed in this fifth embodiment of the toner cartridge of the present invention is the same ladder-shaped agitator type rotatable member provided with a sheet-shaped member 4 made of a polyester film as employed in the first embodiment of the toner cartridge of the present invention.

Figures 1, 12:
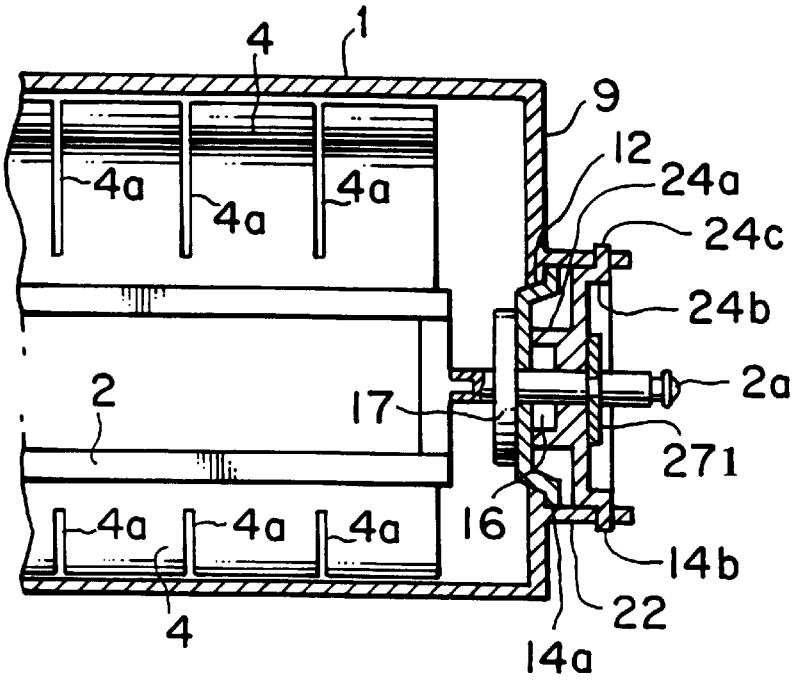
Figures 2, 12:
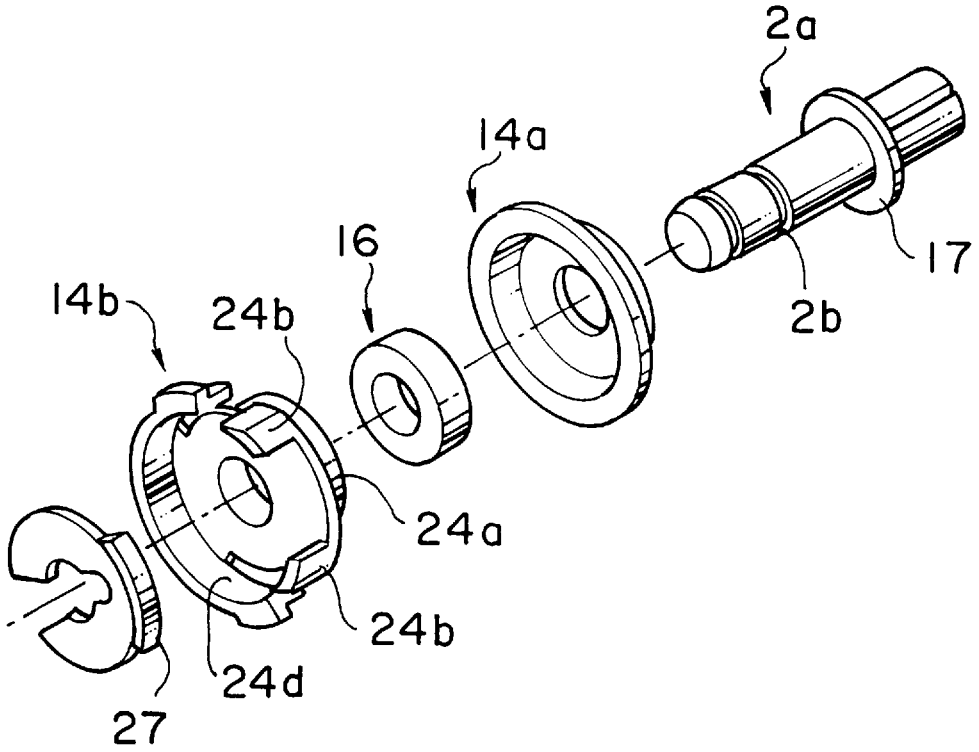
Figures 3, 12:
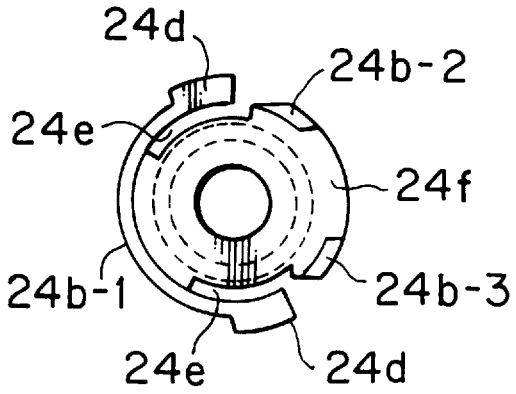

With reference to FIGS. 12-1 to 12-3, a sixth embodiment of the toner cartridge of the present invention will now be explained, wherein the same reference numerals as in FIGS. 1 to 7 designate identical or corresponding parts shown in FIGS. 1 to 7.

In the six embodiment, as the cap member 14 is employed the cap member of type B, comprising a round cap portion 14*a* and a round bearing member 14*b* which are separable.

FIG. 12-1 is a schematic partial cross-sectional view of the sixth embodiment of the toner cartridge of the present invention, in particular, showing the attachment of the cap member to the opening 12 of the container body 1.

In this embodiment, as the rotatable member 2, there is employed a ladder-shaped agitator type rotatable member provided with a sheet-shaped member 4 made of a polyester film with a plurality of cut-out portions 4*a*. The rotation center shaft 2*a* is separable from the central portion of the rotatable member 2. The cap portion 14*a*, the sealing member 16 and the bearing member 14*b* are successively provided in close contact with each other on the support member 17 which is integrally provided on the rotation center shaft 2*a*. Thus, the cap portion 14*a*, the sealing member 16 and the bearing member 14*b* are held between the support member 17 and a fixing member 27.

The cap portion 14*a* comprises a flange portion and a fitting portion. The fitting portion is fitted into the opening 12 formed in the container body 1. In a vacant portion formed by a cylindrical wall 24*a* formed on one side of the bearing member 14*b*, there is fitted a part of the sealing member 16, having almost the same diameter as that of the vacant portion formed by the cylindrical wall 24*a*. The sealing member 16 is held in a depressed state between the cap portion 14*a* fitted into the opening 12 and the bearing member 14*b*. The bearing member 14*b* is fixed, while urged in the outside direction, by the resilience of the sealing member 16, whereby the predetermined perpendicular position thereof to the rotation center shaft 2*a* can be accurately maintained.

Furthermore, the above-mentioned cylindrical wall 24*a* provided on the bearing member 14*b* is fitted into a concave portion formed in the fitting portion formed in the cap portion 14*a*. A cylindrical wall 24*b* is formed on the other side of the bearing member 14*b*. In two same positions in the cylindrical wall 24*b* and the bearing member 14*b*, notches 24*e* (not shown) are formed, and pawls 24*d* (not shown) are formed so as to position the cylindrical wall 24*b* in a floating posture just like a spring.

The fixing member 27 is located in the concave portion formed by the cylindrical wall 24*b* provided on the bearing member 14*b*.

A cylindrical wall 22 is formed so as to encircle the opening 12 with a space from the edge of the opening 12. The bearing member 14*b* is attached to the cylindrical wall 22, and two holes are formed in an upper portion of the cylindrical wall 22, in which the above-mentioned pawls 24*d* of the bearing member 14*b* are engaged, whereby a hook mechanism is formed. Thus, the bearing member 14*b* is firmly fixed to the container body In a specific example of this embodiment, the length of the rotation center shaft 2*a* is about 2.5 cm, the diameter of the flange portion 24*c* of the bearing member 14*b* is about 2.5 cm, the diameter of the opening 12 is about 1.8 cm, and in the case of the cap portion 14*a*, a portion of the through hole thereof with which the rotation center shaft 2*a* is in contact is about 1 mm, and in the case of the bearing member 14*b*, a portion of the through hole thereof with which the rotation center shaft 2*a* is in contact is about 3.0 mm.

FIG. 12-2 is a schematic perspective view of the cap member 14*a* and other parts to be successively attached to the rotation center shaft 2*a* in the sixth embodiment of the toner cartridge of the present invention. In the rotation center shaft 2*a*, a groove 2*b* is formed. On the support member 17 provided on the rotation center shaft 2*a*, the cap portion 14*a*, the sealing member 16 and the bearing member 14*b* are successively fitted, and these fitted members are held between the support member 17 and the fixing member 27 fixed to the groove 26.

FIG. 12-3 is a schematic top view of the bearing member 14*b* fixed to the fixing member 27 in the sixth embodiment. In the flange portion 24*c*, the two notches 24*e* are formed in the two corresponding positions, the pawls 24*d* are provided so as to position the cylindrical wall 24*b* in a floating state just like a spring. Further, for easy attachment of the fixing member 27, a partly cut away portion 24*f* is formed in the cylindrical wall 24*b*. The bearing member 14*b* is fitted into the above-mentioned cylindrical wall 22 provided at the opening 12 and is stably supported by each of the portions 24*b*-1, 24*b*-2 and 24*b*-3 of the cylindrical wall 24*b*.

Figures 1, 13:
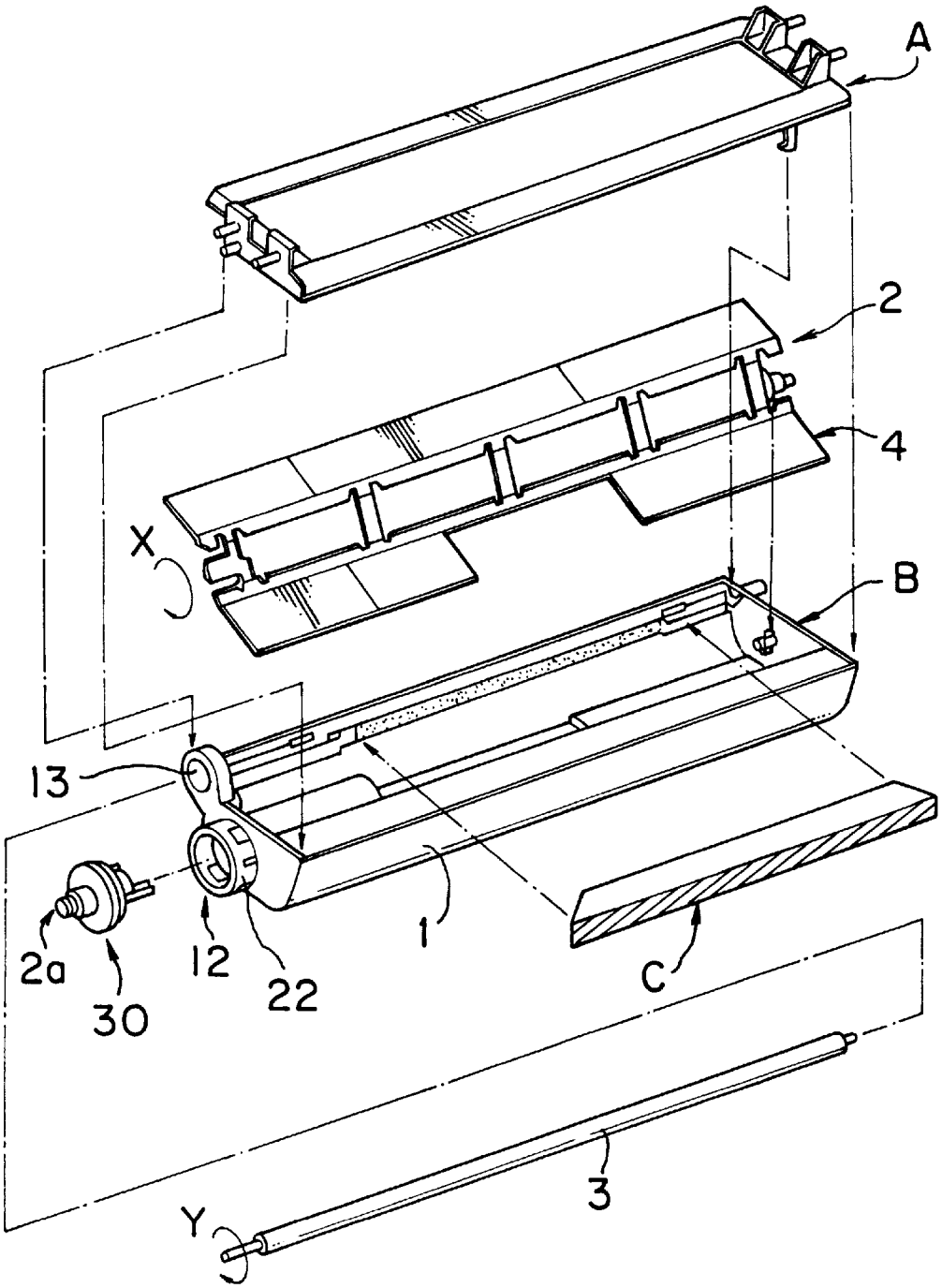
Figures 2, 13:
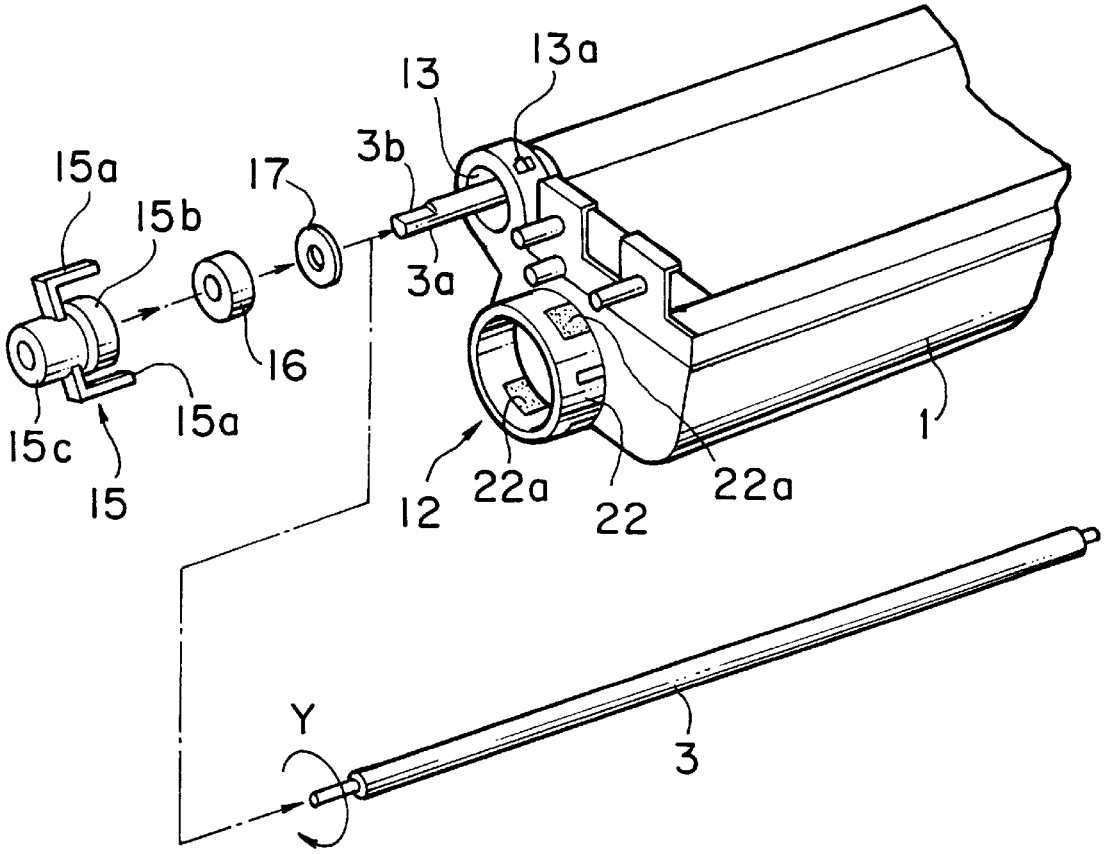

With reference to FIGS. 13-1 and 13-2, a seventh embodiment of the toner cartridge of the present invention will now be explained, wherein the same reference numerals as in FIGS. 1 to 12-3 designate identical or corresponding parts shown in FIGS. 1 to 12-3.

The seventh embodiment is the same as the sixth embodiment except that a magnetic roller is provided in addition to the rotatable member employed in the sixth embodiment.

FIG. 13-1 is a schematic perspective view of an upper lid A and a toner holding portion B of the container body 1, which are separated, in the seventh embodiment of the toner cartridge of the present invention, with a magnetic roller being incorporated in addition to the ladder-shaped agitator type rotatable member 2 provided with the sheet-shaped member 4 made of a polyester film in the container body 1.

In the same manner as explained in the six embodiment, on the support member 17 provided on the rotation center shaft 2*a*, the cap portion 14*a*, the sealing member 16 and the bearing member 14*b* are successively fitted, and these fitted members are held between the support member 17 and a fixing member (not shown) to constitute a composite member 30. The composite member 30 is fitted into the opening 12 formed in the toner holding portion B. Furthermore, the magnetic roller 3 is fitted into the opening 13.

FIG. 13-2 is a schematic partial enlarged perspective view of the two openings formed in the toner holding portion B in the seventh embodiment.

In the cylindrical wall 22 provided at the opening 12, there are formed two holes 22*a* with which the two pawls 24*d* shown in FIG. 12-3 are engaged.

At a top end portion of the magnetic roller 3 which is fitted into the opening 13, a flat portion 3*b* is formed, and a support member 17 made of a plastic material is fixed to the flat portion 3*b*. The sealing member 16 and the cap member 15 of type A are successively fitted on the support member 17. These members are fixed with a pair of pawls 15*a* formed in the cap member 15 being inserted into the holes 13*a* formed in the opening 13.

The cap member 15 includes a cylindrical wall 15*b* on one side thereof and a cylindrical wall 15*c* having a smaller diameter than that of the cylindrical wall 15*b* on the opposite side thereof, and a vacant portion is formed inside the cylindrical wall 15*b*, in which the sealing member 16 is fitted.

As shown in FIG. 13-1, in the seventh embodiment of the toner cartridge of the present invention, a scraper C which comes into contact with the surface of the magnetic roller 3 is provided, so that the toner held on the surface of the magnetic roller 3 is scraped off to supply the toner for image formation.

A gear (not shown) is connected to the top end portion of each of the rotation center shafts 2*a* and 3*a*. Each gear is connected to a rotation drive source of the image formation apparatus, whereby the rotatable member 2 and the magnetic roller 3 are respectively rotated in the directions X and Y.

Figure 14:
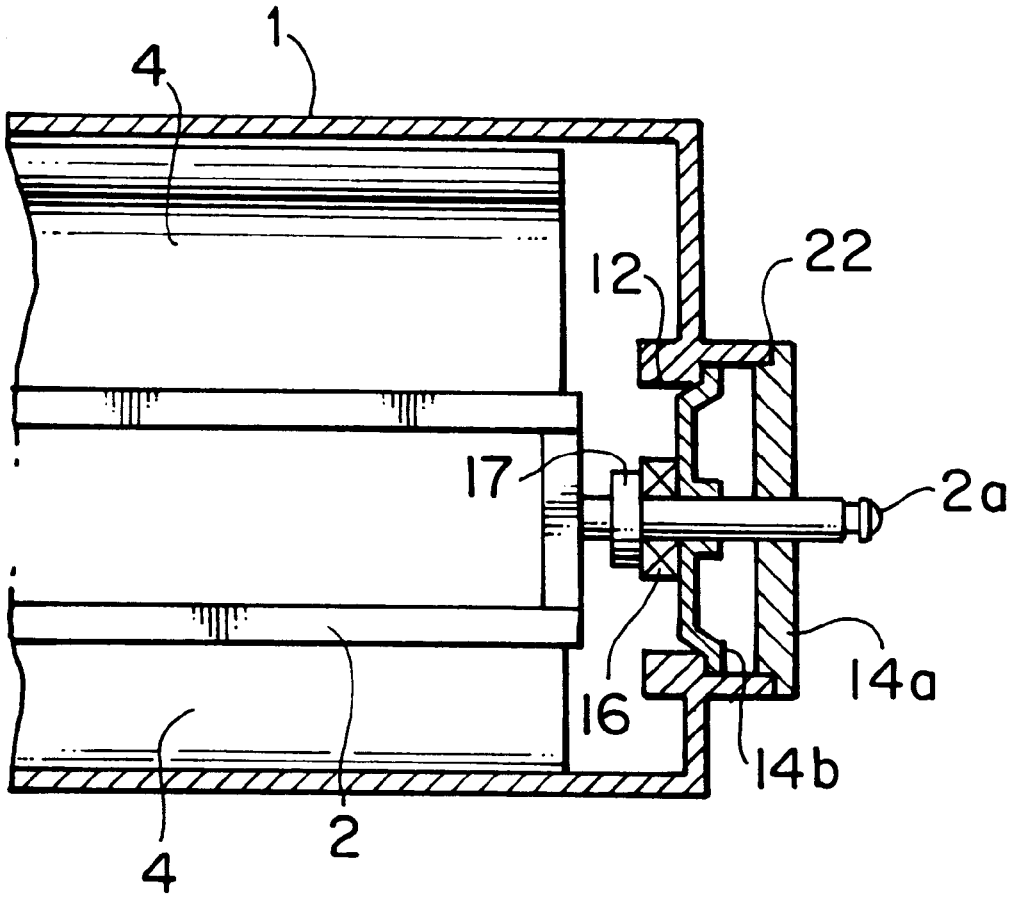
FIG. 14 is a schematic cross-sectional front view of an eighth embodiment of the toner cartridge of the present invention, in particular, showing the fitting of a cap member comprising a cap portion and a bearing member of type B into an opening formed in the toner container.

With reference to FIG. 14, an eighth embodiment of the toner cartridge of the present invention will now be explained, wherein the same reference numerals as in FIGS. 1 to 13-2 designate identical or corresponding parts shown in FIGS. 1 to 13-2.

FIG. 14 is a partial schematic cross-sectional front view of the eighth embodiment, in particular, showing the fitting of the cap member of type B comprising the cap portion 14*a* and the bearing member 14*b* into the opening 12 formed in the toner container 1.

The bearing member 14*b* is fitted into the opening 12, and the cap portion 14*a* is fitted into a cylindrical wall 22. The rotation center shaft 2*a* is caused to pass through the through holes formed in these members.

The bearing member 14*b* is supported by the support member 17 which is integrally disposed on the rotation center shaft 2*a*, with the sealing member 16 being interposed between the support member 1 and the bearing member 14. Because of the above-mentioned structure, the toner held in the container body 1 does not leak from the container body 1 even when the rotatable member 2 is rotated, or even when there is a gap between the rotation center shaft 2*a* and the through hole formed in the bearing member 14*b*.

As the ratable member 2, the same ladder-shaped agitator type rotatable member provided with the sheet-shaped member as employed in the above-mentioned first embodiment is employed, and the other portions of the eighth embodiment which are not explained above are the same as in the above-mentioned sixth or seventh embodiment.

Japanese Patent Application No. 08-279045 filed Oct. 22, 1996, Japanese Patent Application No. 09-043803 filed Feb. 27, 1997, and Japanese Patent Application filed Oct. 20, 1997 (its filing number is not yet available) are hereby incorporated by reference.

What is claimed is:

1. A toner cartridge comprising:

a container body for holding toner therein, at least one rotatable member comprising a rotation center shaft, for discharging said toner from said container body, disposed in said container body, said container body having an opening at one end thereof in the axial direction of rotation of said rotatable member, and a cap member for opening and closing said opening formed in said container body, said cap member serving as a bearing member for said rotatable member thereon and being detachable through said opening in the direction of the axis of rotation of said rotatable member.

2. The toner cartridge as claimed in claim 1, wherein said cap member comprises a cap portion and a bearing portion which constitute one integral body member, said bearing portion being capable of serving as a bearing member for said rotatable member thereon, and has a through hole through which said rotation center shaft passes and is disposed at said opening.

3. The toner cartridge as claimed in claim 2, wherein said opening has a cylindrical wall which extends from the edge of said opening, and said cap member is attached to said cylindrical wall.

4. The toner cartridge as claimed in claim 3, wherein said cap portion can be connected to said cylindrical wall through a screw mechanism or a hook mechanism.

5. The toner cartridge as claimed in claim 4, wherein said hook mechanism comprises an engagement pawl formed in said cap portion, and a pawl fixing portion is formed in said cylindrical wall, or a pawl fixing portion is formed in said cap portion, and an engagement pawl portion is formed in said cylindrical wall.

6. The toner cartridge as claimed in claim 3, wherein said opening, said cap member, and said cylindrical wall are substantially round shaped in view of the axial direction of said rotation center shaft and coaxially disposed on the axis of said rotation center shaft.

7. The toner cartridge as claimed in claim 2, wherein said cap member comprises a fitting portion and a flange portion.

8. The toner cartridge as claimed in claim 2, further comprising a sealing member having a through hole, which is disposed at the inner side of said cap member in close contact therewith, inside said container body, with said rotation center shaft passing through said through hole of said sealing member.

9. The toner cartridge as claimed in claim 8, further comprising a support member for supporting said sealing member, with said support member being fixed on said rotation center shaft, substantially at right angles with respect to the axis of said rotation center shaft.

10. The toner cartridge as claimed in claim 8, wherein said sealing member is made of felt.

11. The toner cartridge as claimed in claim 2, wherein said opening and said cap member are substantially round shaped in view of the axial direction of said rotation center shaft and coaxially disposed on the axis of said rotation center shaft.

12. The toner cartridge as claimed in claim 1, wherein said cap member comprises a cap portion and a bearing member which are separable, constituting a two-part separable member, and each of said cap portion and said bearing member has a through hole through which said rotation center shaft passes said cap portion and said bearing member.

13. The toner cartridge as claimed in claim 12, further comprising a cylindrical wall which is provided so as to encircle said opening, extending around said opening with a space from the edge of said opening, and one of said cap portion or said bearing member is fitted into one of said opening or said cylindrical wall, and the other of said cap portion or said bearing member is fitted into the other of said opening or said cylindrical wall.

14. The toner cartridge as claimed in claim 13, wherein at least one of said cap portion or said bearing member can be connected to said opening or said cylindrical wall through a screw mechanism or a hook mechanism.

15. The toner cartridge as claimed in claim 14, wherein said hook mechanism comprises an engagement pawl formed in one of said cap portion or said bearing member, and a pawl fixing portion formed in said cylindrical wall, or a pawl fixing portion formed in one of said cap portion or said bearing member, and an engagement pawl portion formed in said cylindrical wall.

16. The toner cartridge as claimed in claim 15, further comprising a sealing member having a through hole, which is disposed between said bearing member and said cap portion in close contact with both of said bearing member and said cap portion, with said rotation center shaft passing through said through hole of said sealing member.

17. The toner cartridge as claimed in claim 16, further comprising a support member for supporting the inner most member of said bearing member or said cap portion in the inside of said container body, with said support member being fixed on said rotation center shaft, substantially at right angles with respect to the axis of said rotation center shaft, at the inside of the inner most member.

18. The toner cartridge as claimed in claim 17, further comprising a detachable fixing member for holding said bearing member, with said cap portion, said sealing member and said bearing member being disposed in this order in view of the inner direction of said container body, and said bearing member being held by said fixing member, and said cap portion being disposed at said opening.

19. The toner cartridge as claimed in claim 18, wherein said cap portion and/or said bearing member comprises a fitting portion formed by said cylindrical wall provided at an outer peripheral edge portion thereof, and a flange portion formed along a peripheral portion of said cylindrical wall, and the inner diameter of said cylindrical wall is larger than the diameter of said sealing member, and said cylindrical inner wall has a concave portion at the inside thereof, in which at least part of said sealing member is incorporated.

20. The toner cartridge as claimed in claim 19, wherein said bearing member is substantially round shaped in view of the axis of said rotation center shaft, and has a through hole, and a cylindrical wall is provided between the outer peripheral edge of said bearing member and said through hole of said bearing member, and the inner diameter of said cylindrical wall is larger than the diameter of said sealing member, and said cylindrical wall has a concave portion at the inside thereof, in which at least part of said sealing member is incorporated.

21. The toner cartridge as claimed in claim 16, further comprising a detachable fixing member for holding said bearing member, with said cap portion, said sealing member and said bearing member being disposed in this order in view of the inner direction of said container body, and said bearing member being held by said fixing member, and said cap portion being disposed at said opening.

22. The toner cartridge as claimed in claim 16, wherein said opening, said cap portion, said bearing member and said sealing member are substantially round shaped in view of the axial direction of said rotation center shaft and coaxially disposed on the axis of said rotation center shaft.

23. The toner cartridge as claimed in claim 22, wherein said cap portion has a flange portion and a cylindrical wall which extends from along the edge of said cap portion, said bearing member has a through hole, a cylindrical wall is provided between an outer peripheral edge of said bearing member and said through hole of said bearing member, said bearing member has a diameter which is larger than the diameter of said flange portion of said cap portion, and the inner diameter of said cylindrical wall provided along the edge of said cap portion is larger than the outer diameter of said cylindrical wall provided between the outer peripheral edge of said bearing member and said through hole of said bearing member, and said cylindrical wall provided between the outer peripheral edge of said bearing member and said through hole of said bearing member, and said sealing member are incorporated in said cylindrical wall which extends from along the edge of said cap portion.

24. The toner cartridge as claimed in claim 23, further comprising an additional cylindrical wall which is provided along the outer peripheral edge of said bearing member, on the back side of said bearing member with respect to the side thereof on which said cylindrical wall is provided between the outer peripheral edge of said bearing member and said through hole of said bearing member, a notch cut on part of said additional cylindrical wall, a projection provided on said cylindrical wall provided at said opening, said notch and said projection constituting a fixing hook structure.

25. The toner cartridge as claimed in claim 13, wherein said opening, said cap portion, said bearing member and said cylindrical wall are substantially round shaped in view of the axial direction of said rotation center shaft and coaxially disposed on the axis of said rotation center shaft.

26. The toner cartridge as claimed in claim 12, wherein at least one of said cap portion or said bearing member comprises a fitting portion and a flange portion.

27. The toner cartridge as claimed in claim 12, wherein said cap member constitutes a mutually incorporated structure of said cap portion and said bearing member.

28. The toner cartridge as claimed in claim 12, wherein said cap portion has a smaller flexibility than the flexibility of said bearing member.

29. The toner cartridge as claimed in claim 12, wherein the length of a portion of said through hole of said bearing member which is in contact with said rotation center shaft is longer than the length of a portion of said through hole of said cap portion which is in contact with said rotation center shaft.

30. The toner cartridge as claimed in claim 12, further comprising a sealing member having a through hole, which is disposed at the inner side of the inner most member of said bearing member or said cap portion in close contact therewith, inside said container body, with said rotation center shaft passing through said through hole of said sealing member.

31. The toner cartridge as claimed in claim 30, further comprising a support member for supporting said sealing member, with said support member being fixed on said rotation center shaft, substantially at right angles with respect to the axis of said rotation center shaft.

32. The toner cartridge as claimed in claim 12, further comprising a sealing member having a through hole, which is disposed between said bearing member and said cap portion in close contact with both of said bearing member and said cap portion, with said rotation center shaft passing through said through hole of said sealing member.

33. The toner cartridge as claimed in claim 32, further comprising a support member for supporting the inner most member of said bearing member or said cap portion in the inside of said container body, with said support member being fixed on said rotation center shaft, substantially at right angles with respect to the axis of said rotation center shaft, at the inside of the inner most member.

34. The toner cartridge as claimed in claim 33, further comprising a detachable fixing member for holding said bearing member, with said cap portion, said sealing member and said bearing member being disposed in this order in view of the inner direction of said container body, and said bearing member being held by said fixing member, and said cap portion being disposed at said opening.

35. The toner cartridge as claimed in claim 34, wherein said opening, said cap portion, said bearing member, said cylindrical wall, said sealing member, and said support member are substantially round shaped in the axial direction of the axis of said rotation center shaft and coaxially disposed on the axis of said rotation center shaft.

36. The toner cartridge as claimed in claim 35, wherein said cap portion and/or said bearing member comprises a fitting portion formed by said cylindrical wall provided at an outer peripheral edge portion thereof, and a flange portion formed along a peripheral portion of said cylindrical wall, and the inner diameter of said cylindrical wall is larger than the diameter of said sealing member, and said cylindrical inner wall has a concave portion at the inside thereof, in which at least part of said sealing member is incorporated.

37. The toner cartridge as claimed in claim 36, wherein said bearing member is substantially round shaped in view of the axis of said rotation center shaft, and has a through hole, and said cylindrical wall is provided between the outer peripheral edge of said bearing member and said through hole of said bearing member, and the inner diameter of said cylindrical wall is larger than the diameter of said sealing member.

38. The toner cartridge as claimed in claim 32, further comprising a detachable fixing member for holding said bearing member, with said cap portion, said sealing member and said bearing member being disposed in this order in view of the inner direction of said container body, and said bearing member being held by said fixing member, and said cap portion being disposed at said opening.

39. The toner cartridge as claimed in claim 12, wherein said opening, said cap portion, and said bearing member are substantially round shaped in view of the axial direction of said rotation center shaft and coaxially disposed on the axis of said rotation center shaft.

40. The toner cartridge as claimed in claim 1, wherein said opening and said cap member are substantially round shaped in view of the axial direction of said rotation center shaft and coaxially disposed on the axis of said rotation center shaft.

41. The toner cartridge as claimed in claim 1, wherein said rotation center shaft comprises an engagement separation mechanism by which a central portion of said rotatable member can be separated from said rotation center shaft.

42. The toner cartridge as claimed in claim 1, further comprising a drive transmission member for driving said rotatable member in rotation, which is disposed at a top end portion of said rotation center shaft on the side of said opening formed in said container body.

43. The toner cartridge as claimed in claim 42, further comprising a fixing member for fixing said drive transmission member with tight sealing on the outside of said drive transmission member in view of said container body.

44. The toner cartridge as claimed in claim 1, wherein said rotatable member is of an agitator type member or of a replenishment roller type member.

45. The toner cartridge as claimed in claim 1, wherein said rotatable member is a blanked out ladder-shaped agitator provided with a flexible sheet-shaped member extending from the outer peripheral portion of said blanked out ladder-shaped agitator, and the outer peripheral diameter of said flexible sheet-shaped member can be made smaller than the diameter of said opening by pulling out said rotatable member in the axial direction thereof as said rotatable member is rotated.

46. The toner cartridge as claimed in claim 1, wherein said rotatable member is a blanked out ladder-shaped agitator provided with a flexible sheet-shaped member extending from the outer peripheral portion of said blanked out ladder-shaped agitator, and the outer peripheral diameter of said flexible sheet-shaped member can be made larger than the diameter of said opening after said flexible sheet-shaped member is inserted into said container body.

47. The toner cartridge as claimed in claim 1, wherein said rotatable member is a blanked out ladder-shaped agitator provided with a flexible sheet-shaped member extending from the outer peripheral portion of said blanked out ladder-shaped agitator, and the outer peripheral diameter of said flexible sheet-shaped member can be made smaller than the diameter of said opening by pulling out said rotatable member in the axial direction thereof as said rotatable member is rotated, and the outer peripheral diameter of said flexible sheet-shaped member can be made larger than the diameter of said opening after said flexible sheet-shaped member is inserted into said container body.

48. The toner cartridge as claimed in claim 47, wherein said flexible sheet-shaped member is made of a polyester film.

49. The toner cartridge as claimed in claim 1, wherein said rotatable member is a replenishment roller.

50. The toner cartridge as claimed in claim 49, further comprising a sealing member which is disposed between an end surface of said replenishment roller and said cap member in close contact therewith.

51. The toner cartridge as claimed in claim 49, wherein said replenishment roller is a magnetic roller.

52. The toner cartridge as claimed in claim 1, further comprising a guide member for guiding an end portion of said rotatable member from said opening of said container body to a predetermined attachment position therefor on the opposite side of said opening in said container body when incorporating said rotatable member into said container body, said guide member being fixed near an end portion of said rotation center shaft opposite to the end portion thereof located at said opening, substantially at right angles to the axial direction of said rotation center shaft.

53. The toner cartridge as claimed in claim 52, wherein said guide member is rotatably supported on said rotatable center shaft, with an external peripheral portion of said guide member being in sliding contact with at least part of an inner peripheral surface of said container body.

54. The toner cartridge as claimed in claim 1, wherein a plurality of said rotatable members is disposed in said container body, at least one of which is detachable by pulling from said container body.

55. The toner cartridge as claimed in claim 1, further comprising toner with which said container body is loaded.

56. An image formation apparatus comprising a development unit and a toner cartridge which holds toner, wherein said toner cartridge is disposed above said development unit and comprises:

a container body for holding toner therein, at least one rotatable member comprising a rotation center shaft, for discharging said toner from said container body, disposed in said container body, said container body having an opening at one end thereof in the axial direction of rotation of said rotatable member, and a cap member for opening and closing said opening formed in said container body, said cap member serving as a bearing member for said rotatable member thereon and being detachable through said opening in the direction of the axis of rotation of said rotatable member.

57. A method of recycling parts which constitute a toner cartridge comprising the steps of:

detaching a cap member having a bearing portion from a container body, which cap member is fitted into an opening formed in said container body and disposed tightly sealed, in such a state that a rotation center shaft which constitutes a rotatable member passes through a through hole formed in said cap member, pulling out said rotatable member disposed in said container body from said opening, and separating said rotation center shaft and said cap member.

58. The method as claimed in claim 57, wherein a deposited material is removed from at least one of said container body, said rotatable member or said cap member, each of which is separated.

59. The method as claimed in claim 58, further comprising the steps of, using said container body, said rotatable member and said cap member, from at least one of which said deposited material is removed, disposing said cap member tightly sealed on a support which is fixed on said rotation center shaft which constitutes said rotatable member, with said rotation center shaft passing through said through hole formed in said cap member, inserting a top end of another rotation center shaft which constitutes said rotatable member from said opening formed in said container body into said container body, thereby setting said top end portion of said rotation center shaft at a predetermined position, and fixedly fitting said cap member into said opening, thereby constructing said toner cartridge.

60. The method as claimed in claim 59, further comprising the step of loading said constructed toner cartridge with toner.

61. The method as claimed in claim 60, further comprising the step of incorporating said toner cartridge which is loaded with toner into a predetermined place in an image formation apparatus for image formation.

* * * * *